US005533351A

United States Patent [19]

Miyata et al.

[11] Patent Number: 5,533,351

[45] Date of Patent: Jul. 9, 1996

[54] AIR CONDITIONER

[75] Inventors: Kenji Miyata; Hideki Tsujii; Shinichi Oka; Masaaki Takegami; Takeo Ueno; Tetsuya Suda, all of Osaka, Japan

[73] Assignee: Daikin Industries, Ltd., Japan

[21] Appl. No.: 256,611

[22] PCT Filed: Nov. 17, 1993

[86] PCT No.: PCT/JP93/01693

§ 371 Date: Sep. 23, 1994

§ 102(e) Date: Sep. 23, 1994

[87] PCT Pub. No.: WO94/12834

PCT Pub. Date: Jun. 9, 1994

[30] Foreign Application Priority Data

Nov. 20, 1992 [JP] Japan ..... 4-312065
Mar. 24, 1993 [JP] Japan ..... 5-065064

[51] Int. Cl.[6] ..... F25B 41/00; F25B 13/00

[52] U.S. Cl. ..... 62/174; 62/324.4

[58] Field of Search ..... 62/174, 324.4, 62/509

[56] References Cited

U.S. PATENT DOCUMENTS 2,807,943 10/1957 Lynch et al. ..... 62/324.4
4,329,855 5/1982 Larsson .
4,655,051 4/1987 Jones ..... 62/324.4

FOREIGN PATENT DOCUMENTS 0126346 11/1984 European Pat. Off. .
3105796 12/1981 Germany .
42-5495 6/1967 Japan .
49-12701 3/1974 Japan .
50-145790 12/1975 Japan .
51-163054 12/1976 Japan .
52-96444 7/1977 Japan .
62-6669 1/1987 Japan .
4251158 7/1992 Japan .

*Primary Examiner*—William E. Wayner
*Attorney, Agent, or Firm*—Sixbey, Friedman, Leedom & Ferguson; Gerald J. Ferguson, Jr.; Tim L. Brackett, Jr.

[57] ABSTRACT

A reversibly operatable refrigerant circulating circuit (1) is formed in such a manner that a compressor (21), an outdoor heat exchanger (23), a motor-operated expansion valve (25) through which refrigerant flows in both directions and an indoor heat exchanger (31) are connected in this order. Between the motor-operated expansion valve (25) and the indoor heat exchanger (31), there is provided a refrigerant regulator (4) for regulating a circulation amount of refrigerant in a cooling operation cycle and storing liquefied refrigerant in a heating operation cycle. The refrigerant regulator (4) has a first flow pipe (42) to which the outdoor heat exchanger (23) is connected and a second flow pipe (43) which has plural refrigerant holes (45, 45 . . . ) and to which the indoor heat exchanger (31) is connected. Further, there is provided a widening control part (73) for controlling to widen an opening of the motor-operated expansion valve (25) when a pressure HP of high-pressure refrigerant in the refrigerant circulating circuit (1) reaches to a set value. Thus, an accumulator is dispensed with, an allowance range of a charge amount of refrigerant is widened and a rising of the pressure of high-pressure refrigerant is prevented.

17 Claims, 13 Drawing Sheets

AIR CONDITIONER

TECHNICAL FIELD

This invention relates to an air conditioner reversibly operatable between a cooling operation cycle and a heating operation cycle and particularly relates to measures for simplifying a refrigerant circulating circuit thereof.

BACKGROUND ART

There has been commonly known an air conditioner as disclosed in Japanese Patent Application Open Gazette No. 4-251158. The air conditioner has a refrigerant circulating circuit in which a compressor, a four-way selector valve, an outdoor heat exchanger, a rectification circuit, an indoor heat exchanger and an accumulator are connected in this order and which is reversibly operatable between a cooling operation cycle and a heating operation cycle. The rectification circuit has four delivery valves, a motor-operated expansion valve and a receiver located on an upstream side of the expansion valve.

In the refrigerant circulating circuit, during the cooling operation cycle, the outdoor heat exchanger condenses refrigerant transmitted from the compressor, the motor-operated expansion valve reduces the pressure of the refrigerant and then the indoor heat exchanger evaporates the refrigerant. 0n the other hand, during the heating operation cycle, the four-way selector valve is switched over, the indoor heat exchanger condenses refrigerant transmitted from the compressor, the motor-operated expansion valve reduces the pressure of the refrigerant and then the outdoor heat exchanger evaporates the refrigerant.

In the above-mentioned air conditioner, the receiver is provided on a high-pressure line into which high-pressure refrigerant flows all the time and the accumulator is provided on the intake side of the compressor so that surplus refrigerant in the heating operation cycle is stored in the receiver. At a transient time to a steady state in the cooling and heating operation cycles, liquefied refrigerant flowing toward the compressor is removed by the accumulator, thus preventing the liquefied refrigerant from returning to the compressor.

In the air conditioner, however, the accumulator is provided in the refrigerant circulating circuit, which invites increase in devices. Further, pressure loss in the accumulator deteriorates running performance of the air conditioner.

When the accumulator is merely removed from the refrigerant circulating circuit, the receiver has only one function of storing refrigerant and cannot regulate a circulating amount of refrigerant. This reduces an allowance range of a charge amount of refrigerant.

Furthermore, since the rectification circuit is provided in order that the receiver can be set on the high-pressure line all the time, four delivery valves are required. This increases the number of elements and rises the cost of the air conditioner.

It may be considered that the refrigerant circulating circuit is so composed that the refrigerant flows toward the motor-operated expansion valve in both directions. In this case, however, in an operation cycle in case where the receiver is located on a low-pressure line, for example, in the cooling operation cycle in case where the receiver is provided between the motor-operated expansion valve and the indoor heat exchanger, the receiver cannot store liquefied refrigerant of high pressure. Accordingly, the air conditioner cannot cope with a pressure rising of high-pressure refrigerant.

This invention has been made in view of the foregoing problems. The invention has its objects of extending an allowance range of a charge amount of refrigerant and coping with a pressure rising of high-pressure refrigerant, while reducing the number of elements.

DISCLOSURE OF INVENTION

To attain the above objects, in the present invention, a refrigerant regulator is provided on a line which is for low-pressure refrigerant in a cooling operation cycle and for high-pressure refrigerant in a heating operation cycle, or provided on another line which is for low-pressure refrigerant in the heating operation cycle and for high-pressure refrigerant in the cooling operation cycle.

In detail, as shown in FIG. 1, an air conditioner according to claim 1 of the present invention comprises a closed refrigerant circulating circuit (1) having a compressor (21), a thermal-source-side heat exchanger (23), an expansion mechanism (25) into which refrigerant flows in both directions and a used-side heat exchanger (31) which are connected in this order, and being reversibly operatable between a cooling operation cycle and a heating operation cycle, wherein the refrigerant circulating circuit (1) is provided with a refrigerant regulator (4), between the expansion mechanism (25) and the used-side heat exchanger (31), for storing liquefied refrigerant and supplying to the used-side heat exchanger (31) refrigerant of a corresponding amount to a storage amount of the liquefied refrigerant in the cooling operation cycle and for storing liquefied refrigerant in the heating operation cycle.

As shown in FIG.2, an air conditioner according to claim 2 of the present invention comprises a closed refrigerant circulating circuit (1) having a compressor (21), a thermal-source-side heat exchanger (23), an expansion mechanism (25) into which refrigerant flows in both directions and a used-side heat exchanger (31) which are connected in this order, and being reversibly operatable between a cooling operation cycle and a heating operation cycle, wherein the refrigerant circulating circuit (1) is provided with a refrigerant regulator (4), between the expansion mechanism (25) and the thermal-source-side heat exchanger (23), for storing liquefied refrigerant and supplying to the thermal-source-side heat exchanger (23) refrigerant of a corresponding amount to a storage amount of the liquefied refrigerant in the heating operation cycle and for storing liquefied refrigerant in the cooling operation cycle.

Further, in an air conditioner according to claim 3 which is dependent on claim 1, the refrigerant regulator (4) has a storage casing (41), a first flow pipe (42) which is connected at one end thereof to the thermal-source-side heat exchanger (23) via the expansion mechanism (25) and connected at the other end to the storage casing (41), and a second flow pipe (43) which is connected at one end thereof to the used-side heat exchanger (31) and led at the other end into the storage casing (41), and there is formed in the second flow pipe (43) aperture means for passing liquefied refrigerant therethrough between the inside of the second flow pipe (43) and the inside of the storage casing (41) so as to increase an area passable for the liquefied refrigerant as the storage amount of the liquefied refrigerant increases.

Furthermore, in an air conditioner according to claim 4 which is dependent on claim 2, the refrigerant regulator (4) has a storage casing (41), a first flow pipe (42) which is connected at one end thereof to the used-side heat exchanger (31) via the expansion mechanism (25) and connected at the other end to the storage casing (41), and a second flow pipe (43) which is connected at one end thereof to the thermal-source-side heat exchanger (23) and led at the other end into the storage casing (41), and there is formed in the second flow pipe (43) aperture means for passing liquefied refrigerant therethrough between the inside of the second flow pipe (43) and the inside of the storage casing (41) so as to increase an area passable for the liquefied refrigerant as the storage amount of the liquefied refrigerant increases.

Further, in an air conditioner according to claim 5 dependent on claims 3 or 4, the aperture means is composed of plural refrigerant holes (45, 45, . . . ) arranged on the second flow pipe (43) in a vertical direction thereof. In an air conditioner according to claim 6 dependent on claims 3 or 4, the aperture means is a slit formed on the second flow pipe (43) in a vertical direction thereof.

Furthermore, in an air conditioner according to claim 7 dependent on any one of claims 1, 2, 3, 4, 5 and 6, the expansion mechanism (25) is a motor-operated expansion valve (25) whose opening is adjustable and the air conditioner further comprises high-pressure detection means (HPS2) for detecting a pressure of high-pressure refrigerant in the refrigerant circulating circuit (1) and expansion-valve control means (72) for adjusting the motor-operated expansion valve (25) to a reference control opening based on a state of the refrigerant in the refrigerant circulating circuit (1).

An air conditioner according to claim 8 dependent on claim 7 further comprises widening control means (73) for outputting a widening signal to the expansion-valve control means (72) when the pressure of high-pressure refrigerant detected by the high-pressure detection means (HPS2) in the refrigerant circulating circuit (1) in the cooling operation cycle reaches to a set value, whereby the expansion-valve control means (72) controls the opening of the motor-operated expansion valve (25) to be a compensation opening wider than the reference control opening.

Further, an air conditioner according to claim 9 dependent on claim 7 further comprises: supercooling judgment means (75) for judging a supercooling degree of the refrigerant in the thermal-source-side heat exchanger (23) in the cooling operation cycle; and opening compensation means (76) for outputting an opening signal to the expansion-valve control means (72) when the pressure of high-pressure refrigerant detected by the high-pressure detection means (HPS2) in the refrigerant circulating circuit (1) in the cooling operation cycle reaches to a set value, whereby the control means (72) controls the opening of the motor-operated expansion valve (25) to be a compensation opening wider than the reference control opening and widens the compensation opening according to increase of the supercooling degree judged by the supercooling judgment means (75).

Furthermore, in an air conditioner according to claim 10 dependent on claim 9, the supercooling judgment means (75) judges the supercooling degree based on a temperature of the outside air. In an air conditioner according to claim 11 dependent on claim 9, the supercooling judgment means (75) judges the supercooling degree based on a temperature of the outside air and a condensation temperature of the refrigerant in the thermal-source-side heat exchanger (23). In an air conditioner according to claim 12 dependent on claim 9, the supercooling judgment means (75) judges the supercooling degree based on a temperature of the outside air, a temperature of the refrigerant on a discharge side in the compressor (21) and a condensation temperature of the refrigerant in the thermal-source-side heat exchanger (23).

An air conditioner according to claim 13 dependent on any one of claims 1, 3, 5–12 further comprises a by-pass line (12) which is connected at one end thereof to the refrigerant regulator (4) and at the other end between the refrigerant regulator (4) and the used-side heat exchanger (31) and which has a shut-off valve (SV).

Further, an air conditioner according to claim 14 dependent on claim 13 further comprises bypass control means (74) for shutting off the shut-off valve (SV) in the heating operation cycle, for opening the shut-off valve (SV) in the cooling operation cycle and for shutting off the shut-off valve (SV) till a pressure of high-pressure refrigerant in the refrigerant circulating circuit (1) lowers to a set value when the pressure of high-pressure refrigerant rises to a set high pressure in the cooling operation cycle. An air conditioner according to claim 15 dependent on claims 13 or 14 further comprises bypass control means (74) for shutting off the shut-off valve (SV) in the heating operation cycle, for opening the shut-off valve (SV) in the cooling operation cycle and for shutting off the shut-off valve (SV) for a set period when a temperature of the refrigerant on the discharge side in the compressor (21) reaches to a set low temperature in the cooling operation cycle.

Furthermore, an air conditioner according to claim 16 dependent on claim 7 further comprises widening control means (73*a*) for outputting a widening signal to the expansion-valve control means (72) when a pressure of high-pressure refrigerant detected by the high-pressure detection means (HPS2) in the refrigerant circulating circuit (1) in the heating operation cycle reaches to a set value, whereby the expansion-valve control means (72) controls the opening of the motor-operated expansion valve (25) to be a compensation opening wider than the reference control opening.

An air conditioner according to claim 17 dependent on claim 7 further comprises: supercooling judgment means (75*a*) for judging a supercooling degree of the refrigerant in the used-side heat exchanger (31) in the heating operation cycle; and opening compensation means (76*a*) for outputting a widening signal to the expansion-valve control means (72) when the pressure of high-pressure refrigerant detected by the high-pressure detection means (HPS2) in the refrigerant circulating circuit (1) in the heating operation cycle reaches to a set value, whereby the expansion-valve control means (72) controls the opening of the motor-operated expansion valve (25) to be a compensation opening wider than the reference control opening and widens the compensation opening according to increase of the supercooling degree judged by the supercooling judgment means ( 75*a*).

Further, in an air conditioner according to claim 18 dependent on claim 17, the supercooling judgment means (75*a*) judges the supercooling degree based on a room temperature. In an air conditioner according to claim 19 dependent on claim 17, the supercooling judgment means (75*a*) judges the supercooling degree based on a room temperature and a condensation temperature of the refrigerant in the used-side heat exchanger (31). In an air conditioner according to claim 20 dependent on claim 17, the supercooling judgment means (75*a*) judges the supercooling degree based on a room temperature, a temperature of the refrigerant on a discharge side in the compressor (21) and a condensation temperature of the refrigerant in the used-side heat exchanger (31).

Furthermore, an air conditioner according to claim 21 dependent on any one of claims 2, 4–7, 16–20 further comprises a by-pass line (12) which is connected at one end thereof to the refrigerant regulator (4) and at the other end between the refrigerant regulator (4) and the thermal-source-side heat exchanger (23) and which has a shut-off valve (SV).

An air conditioner according to claim 22 dependent on claim 21 further comprises bypass control means (74*a*) for shutting off the shut-off valve (SV) in the cooling operation cycle, for opening the shut-off valve (SV) in the heating operation cycle and for shutting off the shut-off valve (SV) till a pressure of high-pressure refrigerant in the refrigerant circulating circuit (1) lowers to a set value when the pressure rises to a set high pressure in the heating operation cycle. An air conditioner according to claim 23 dependent on claims 21 or 22 further comprises bypass control means (74*a*) for shutting off the shut-off valve (SV) in the cooling operation cycle, for opening the shut-off valve (SV) in the heating operation cycle and for shutting off the shut-off valve (SV) for a set period when a temperature of the refrigerant on a discharge side in the compressor (21) reaches to a set low temperature in the heating operation cycle.

In each of the air conditioners according to claims 1, 3, 5 and 6 having the above constructions, during the cooling operation cycle, high-pressure refrigerant discharged from the compressor (21) circulates in the following manner. The refrigerant condenses in the thermal-source-side heat exchanger (23) thus liquefying. The liquefied refrigerant reduces its pressure through the expansion mechanism (25), for example, through the motor-operated expansion valve (25), flows into the refrigerant regulator (4), evaporates in the used-side heat exchanger (31) and then returns to the compressor (21).

During the heating operation cycle, high-pressure refrigerant discharged from the compressor (21) circulates in the following manner. The refrigerant condenses in the used-side heat exchanger (31) thus liquefying. The liquefied refrigerant flows into the refrigerant regulator (4), reduces its pressure through the motor-operated expansion valve (25), evaporates in the thermal-source-side heat exchanger (23) and then returns to the compressor (21).

In the cooling operation cycle, the refrigerant corresponding to a load required by the used-side heat exchanger (31) is regulated by the aperture means of the refrigerant regulator (4), in detail, by the plural refrigerant holes (45, 45, . . . ) or the single slit, so that a set amount of refrigerant is supplied to the used-side heat exchanger (31). Lubricating oil standing in the refrigerant regulator (4) during the cooling operation cycle flows out from the refrigerant holes (45, 45, . . . ) or the slit and returns to the compressor (21) via the used-side heat exchanger (31).

On the other hand, in the heating operation cycle, surplus refrigerant stands in the refrigerant regulator (4).

Further, in each of the air conditioners according to claims 2, 4, 5 and 6, during the cooling operation cycle, high-pressure refrigerant discharged from the compressor (21) circulates in the following manner. The refrigerant condenses in the thermal-source-side heat exchanger (23) thus liquefying. The liquefied refrigerant flows into the refrigerant regulator (4), reduces its pressure through the expansion mechanism (25), for example, through the motor-operated expansion valve (25), evaporates in the used-side heat exchanger (31) and then returns to the compressor (21).

During the heating operation cycle, high-pressure refrigerant discharged from the compressor (21) circulates in the following manner. The refrigerant condenses in the used-side heat exchanger (31) thus liquefying. The liquefied refrigerant reduces its pressure through the motor-operated expansion valve (25), flows into the refrigerant regulator (4), evaporates in the thermal-source-side heat exchanger (23) and then returns to the compressor (21).

In the heating operation cycle, the refrigerant corresponding to a load required by the thermal-source-side heat exchanger (23) is regulated by the aperture means of the refrigerant regulator (4), in detail, by the plural refrigerant holes (45, 45, . . . ) or the single slit, so that a set amount of refrigerant is supplied to the thermal-source-side heat exchanger (23). Lubricating oil standing in the refrigerant regulator (4) during the heating operation cycle flows out from the refrigerant holes (45, 45, . . . ) or the slit and returns to the compressor (21) via the thermal-source-side heat exchanger (23).

On the other hand, in the cooling operation cycle, surplus refrigerant stands in the refrigerant regulator (4).

Furthermore, in each of the air conditioners according to claims 7 and 8, when a pressure of high-pressure refrigerant rises to a set value at a transient time to a steady state in the cooling operation cycle, the high-pressure detection means (HPS2) outputs a high-pressure signal. The widening control means (73) receives the high-pressure signal to output a widening signal. Then, the expansion-valve control means (72) opens the motor-operated expansion valve (25) at an opening slightly wider than the reference control opening. Consequently, the liquefied refrigerant which has stood in the thermal-source-side heat exchanger (23) at the rising of the pressure of high-pressure refrigerant flows into the refrigerant regulator (4) thus lowering the pressure of high-pressure refrigerant. Further, since the liquefied refrigerant stands in the refrigerant regulator (4), this prevents the liquefied refrigerant from flowing backward.

In the air conditioner according to claim 16, when a pressure of high-pressure refrigerant rises to a set value at a transient time to a steady state in the heating operation cycle, the high-pressure detection means (HPS2) outputs a high-pressure signal. The widening control means (73*a*) receives the high-pressure signal to output a widening signal. Then, the expansion-valve control means (72) opens the motor-operated expansion valve (25) at an opening slightly wider than the reference control opening. Consequently, the liquefied refrigerant which has stood in the used-side heat exchanger (31) at the rising of the pressure of high-pressure refrigerant flows into the refrigerant regulator (4) thus lowering the pressure of high-pressure refrigerant. Further, since the liquefied refrigerant stands in the refrigerant regulator (4), this prevents the liquefied refrigerant from flowing backward.

Further, in the air conditioner according to claim 9, when a pressure of high-pressure refrigerant rises at a transient time to a steady state in the cooling operation cycle, the opening compensation means (76) outputs an opening signal showing a compensation opening wider than the reference control opening in accordance with a supercooling degree judged by the supercooling judgment means (75). Specifically, the supercooling degree is each judged, based on the temperature of the outside air in the air conditioner according to claim 10, based on the temperature of the outside air and the condensation temperature in the air conditioner according to claim 11, and based on the temperature of the outside air, the temperature of refrigerant on the discharge side in the compressor (21) and the condensation temperature in the air conditioner according to claim 12. Then, in each of the air conditioners according to claims 9–12, the expansion-valve control means (72) opens the motor-operated expansion valve (25) at an opening slightly wider than the reference control opening in accordance with the supercooling degree. Consequently, the liquefied refrigerant which has stood in the thermal-source-side heat exchanger (23) at the rising of the pressure of high-pressure refrigerant flows into the refrigerant regulator (4) thus lowering the pressure of high-pressure refrigerant.

Furthermore, in the air conditioner according to claim 17, when a pressure of high-pressure refrigerant rises at a transient time to a steady state in the heating operation cycle, the opening compensation means (76*a*) outputs an opening signal showing a compensation opening wider than the reference control opening in accordance with a supercooling degree judged by the supercooling judgment means (75*a*). Specifically, the supercooling degree is each judged, based on the room temperature in the air conditioner according to claim 18, based on the room temperature and the condensation temperature in the air conditioner according to claim 19, and based on the room temperature, the temperature of refrigerant on the discharge side in the compressor (21) and the condensation temperature in the air conditioner according to claim 20. Then, in each of the air conditioners according to claims 17–20, the expansion-valve control means (72) opens the motor-operated expansion valve (25) at an opening slightly wider than the reference control opening in accordance with the supercooling degree. Consequently, the liquefied refrigerant which has stood in the used-side heat exchanger (31) at the rising of the pressure of high-pressure refrigerant flows into the refrigerant regulator (4) thus lowering the pressure of high-pressure refrigerant.

In each of the air conditioners according to claims 13–15, 21–23, when a pressure of high-pressure refrigerant rises over a set value, the bypass control means (74, 74*a*) shuts off the shut-off valve (SV) and stores the liquefied refrigerant into the refrigerant regulator (4) thus lowering the pressure of high-pressure refrigerant. When a temperature of refrigerant on the discharge side in the compressor (21) lowers, the bypass control means (74, 74*a*) shuts off the shut-off valve (SV) and stores the liquefied refrigerant into the refrigerant regulator (4) thus preventing a wet running of the air conditioner.

As described above, in the air conditioner according to claim 1, the refrigerant regulator (4) is provided between the expansion mechanism (25) and the used-side heat exchanger (31). Liquefied refrigerant is stored in the refrigerant regulator (4) in the cooling operation cycle and refrigerant of a corresponding amount to a storage amount of the liquefied refrigerant is supplied to the used-side heat exchanger (31). Further, refrigerant is stored in the refrigerant regulator (4) in the heating operation cycle. In the air conditioner according to claim 2, the refrigerant regulator (4) is provided between the thermal-source-side heat exchanger (23) and the expansion mechanism (25). Liquefied refrigerant is stored in the refrigerant regulator (4) in the heating operation cycle and refrigerant of a corresponding amount to a storage amount of the liquefied refrigerant is supplied to the thermal-source-side heat exchanger (23). Further, refrigerant is stored in the refrigerant regulator (4) in the cooling operation cycle. Thus, according to the air conditioners of claims 1 and 2, since it is not required to store liquefied refrigerant by an accumulator as in the conventional art, the accumulator can be considerably minimized or removed. Consequently, devices can be reduced and pressure loss can be lessened. This enhances running performance of the air conditioner and lowers the cost thereof.

In addition, since a circulation amount of the refrigerant is regulated by the refrigerant regulator (4), an allowance range of a charge amount of refrigerant in the refrigerant circulating circuit (1) can be extended. As a result, it is not required to change the charge amount of refrigerant according to a length of piping in the refrigerant circulating circuit (1).

Further, since it is not required to provide a rectification circuit as in the conventional art, delivery valves can be dispensed with thus reducing the number of elements. This lowers the cost of the air conditioner.

According to the air conditioners of claims 3, 4, 5 and 6, since the aperture means such as the plural refrigerant holes (45, 45, . . . ) or the single slit are formed on the second flow pipe (43) of the refrigerant regulator (4), a circulation amount of refrigerant can be controlled with high precision by the plural refrigerant holes (45, 45 . . . ) or the single slit. This enhances preciseness of air conditioning operation.

According to the air conditioners of claims 7, 8 and 16, since the motor-operated expansion valve (25) is widened at a pressure rising of high-pressure refrigerant, liquefied refrigerant in the thermal-source-side heat exchanger (23) or the used-side heat exchanger (31) flows toward the refrigerant regulator (4) and is stored therein. Thereby, the pressure of high-pressure refrigerant can be surely lowered at the pressure rising, and a counter-flow of the refrigerant and a wet running of the air conditioner can be prevented. This leads to a high-reliable operation control of the air conditioner and extends an operation range thereof.

According to the air conditioners of claims 9 and 17, since a pressure rising of high-pressure refrigerant is prevented in such a manner that the compensation opening is changed in accordance with a supercooling degree, air conditioning operation can be executed more precisely. This enhances an energy effective ratio (EER) of the air conditioner and extends an operation range thereof.

According to the air conditioners of claims 10–12, 18–20, since no sensor to be used exclusively for judgment of a supercooling degree is required, a pressure rising of high-pressure refrigerant can be prevented without complicating the construction of the air conditioner.

According to the air conditioners of claims 13, 14, 21 and 22, the by-pass line (12) having the shut-off valve (SV) is connected to the refrigerant regulator (4). When a pressure of high-pressure refrigerant in the refrigerant circulating circuit (1) rises to a set high-pressure value, the bypass control means (74, 74*a*) shuts off the shut-off valve (SV) so that liquefied refrigerant is stored in the refrigerant regulator (4). Thus, the pressure of high-pressure refrigerant can be lowered, that is, a pressure rising of the high-pressure refrigerant can be prevented. This leads to a high-reliable operation control of the air conditioner and extends an operation range thereof.

Further, according to the air conditioners of claims 15 and 23, the by-pass line (12) having the shut-off valve (SV) is connected to the refrigerant regulator (4). When a temperature of refrigerant on the discharge side in the compressor (21) lowers, the bypass control means (74, 74*a*) shuts off the shut-off valve (SV) so that liquefied refrigerant is stored in the refrigerant regulator (4). Accordingly, since a wet running of the air conditioner can be prevented, this presents a high-reliable operation control of the air conditioner.

BEST MODE FOR CARRYING OUT THE INVENTION

Detailed description is made below about embodiments of the present invention with reference to the accompanying drawings.

Figure 1:
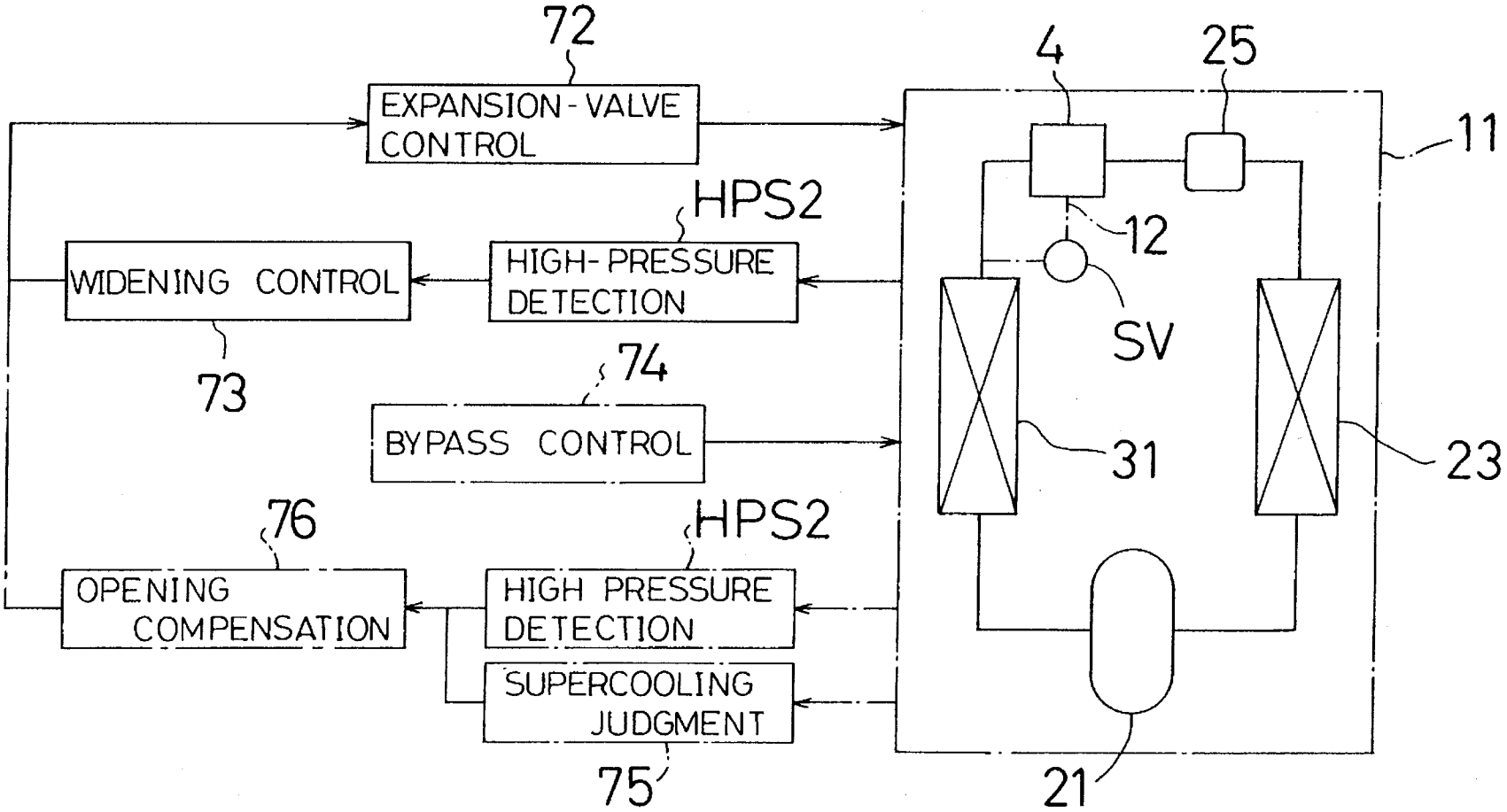
FIG. 1 is a block diagram showing a construction of an air conditioner according to any one of claims 1, 3, 5–15 in the present invention.
Figure 2:
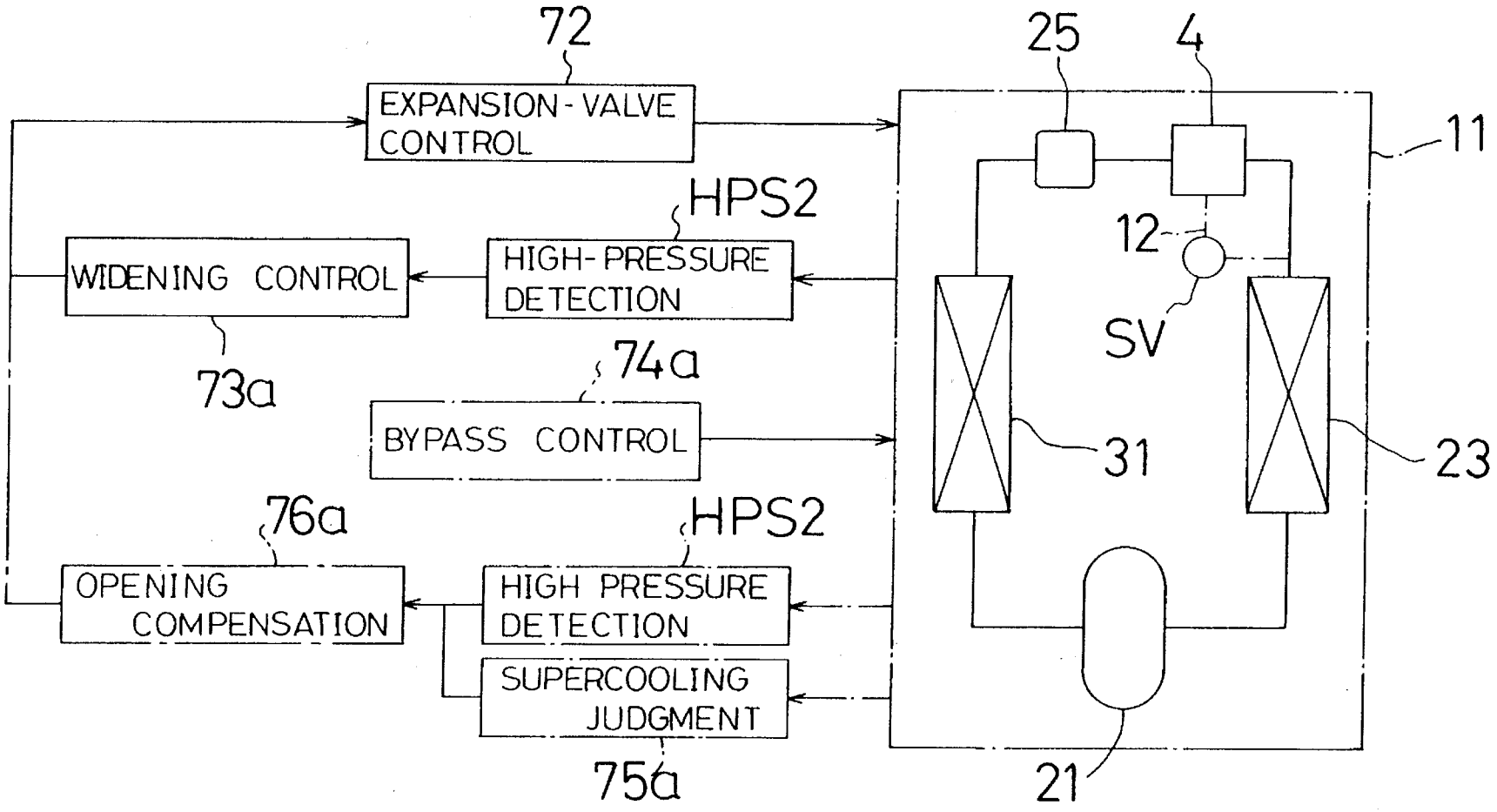
FIG. 2 is a block diagram showing a construction of an air conditioner according to any one of claims 2, 4–7, 16–23 in the present invention.
Figure 3:
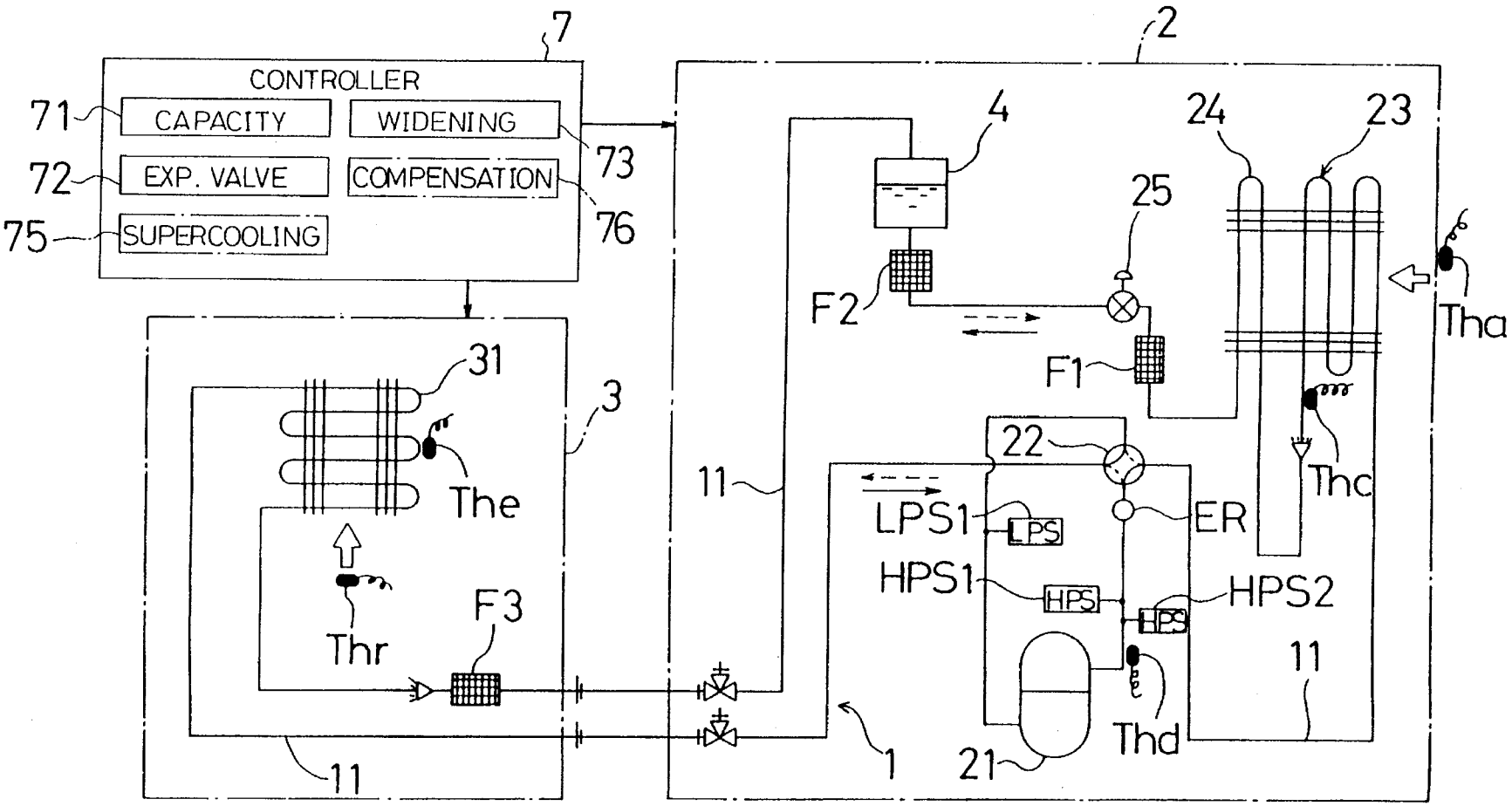
FIG. 3 is a systematic piping diagram showing a first embodiment of a refrigerant circulating circuit of the present invention.

FIG. 3 shows a system of refrigerant piping in an air conditioner according to claims 1, 3, 5, 7 and 8 in the present invention. A refrigerant circulating circuit (1) is a commonly called separate-type one in which a single indoor unit (3) is connected to a single outdoor unit (2).

In the outdoor unit (2), there are provided a scroll-type compressor (21) variably adjustable in operation frequency thereof by an inverter, a four-way selector valve (22) for switching over between a solid line shown in FIG. 3 in a cooling operation cycle and a broken line shown in FIG. 3 in a heating operation cycle, an outdoor heat exchanger (23) which is a thermal-source-side heat exchanger having a function as a condenser in the cooling operation cycle and a function as a evaporator in the heating operation cycle, an auxiliary heat exchanger (24) for the outdoor heat exchanger (23), a motor-operated expansion valve (25) which is an expansion mechanism for reducing a pressure of refrigerant, and a refrigerant regulator (4) which is a feature of the present invention. In the indoor unit (3), there is provided an indoor heat exchanger (31) which is a used-side heat exchanger having a function as an evaporator in the cooling operation cycle and a function as a condenser in the heating operation cycle.

The compressor (21), the four-way selector valve (22), the outdoor heat exchanger (23), the auxiliary heat exchanger (24), the motor-operated expansion valve (25), the refrigerant regulator (4) and the indoor heat exchanger (31) are connected in this order by refrigerant piping (11). The refrigerant circulating circuit (1) is composed of a closed circuit so as to transfer heat by a circulation of refrigerant and reversibly operate between the cooling operation cycle and the heating operation cycle.

As a feature of the present invention, the refrigerant circulating circuit (1) is so composed that refrigerant flows into the motor-operated expansion valve (25) in both directions. In other words, the motor-operated expansion valve (25) is so composed that the refrigerant in the cooling operation cycle and the refrigerant in the heating operation cycle are reverse in flow direction to each other and reduce its pressure (In FIG. 3, the solid line and the broken line show the cooling operation and the heating operation respectively). Further, the refrigerant circulating circuit (1) is formed into a circuit without an accumulator. An end of the indoor heat exchanger (31), which is located on an outlet side of refrigerant in the cooling operation cycle and on an inlet side of refrigerant in the heating operation cycle, is connected to the compressor (21) via the four-way selector valve (22).

Figure 4:
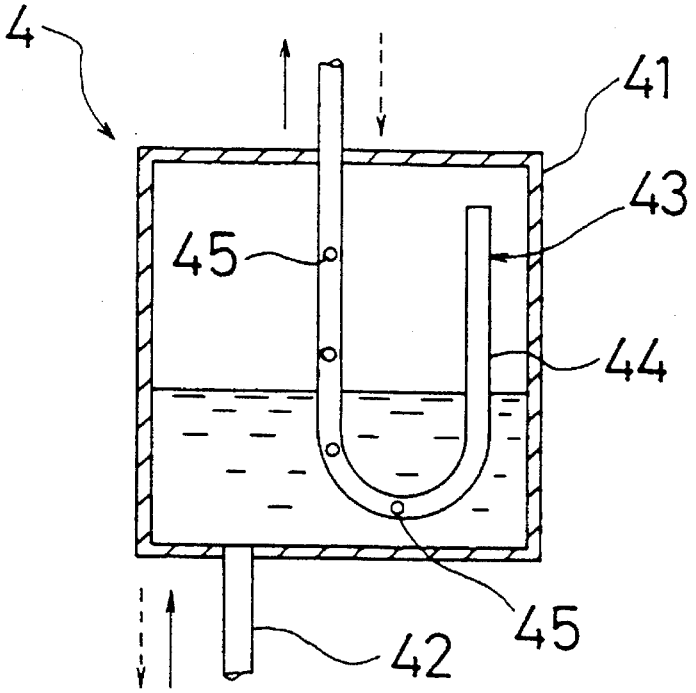
FIG. 4 is an enlarged sectional view showing a refrigerant regulator.

As shown in FIG. 4, the refrigerant regulator (4) which is a feature of the present invention is composed in such a manner that a first flow pipe (42) and a second flow pipe (43) are connected to a storage casing (41). The refrigerant regulator (4) is interposed in the refrigerant piping (11) which is a line for low-pressure liquefied refrigerant in the cooling operation cycle and for high-pressure liquefied refrigerant in the heating operation cycle. The storage casing (41) is composed so as to be capable of storing liquefied refrigerant and have a capacity corresponding to a charge amount of refrigerant in the refrigerant circulating circuit (1).

Further, the first flow pipe (42) is connected at an end thereof to a bottom face of the storage casing (41) and at the other end to the refrigerant piping (11) toward the outdoor heat exchanger (23). The first flow pipe (42) is composed so as to lead the liquefied refrigerant sent from the outdoor heat exchanger (23) into the storage casing (41) in the cooling operation cycle and lead out the liquefied refrigerant from the storage casing (41) to the outdoor heat exchanger (23) in the heating operation cycle (In FIG. 4, a solid line and a broken line show the cooling operation and the heating operation respectively).

An end of the second flow pipe (43) is formed into an inner pipe portion (44) which is led inside the storage casing (41) through an upper part thereof, and the second flow pipe (43) is connected at the other end to the refrigerant piping (11) toward the indoor heat exchanger (31). The second flow pipe (43) is composed so as to lead out the liquefied refrigerant from the storage casing (41) to the indoor heat exchanger (31) in the cooling operation cycle and lead the liquefied refrigerant sent from the indoor heat exchanger (31) into the storage casing (41) in the heating operation cycle (In FIG. 4, the solid line and the broken line show the cooling operation and the heating operation respectively). Further, the inner pipe portion (44) of the second flow pipe (43) is formed in a U-shape and has plural refrigerant holes (45, 45, . . . ) as aperture means. Respective diameters of the refrigerant holes (45, 45 . . . ) are set so as to be same or different from one another. The refrigerant holes (45, 45, . . . ) are so composed that the liquefied refrigerant flows thereinside in the heating operation cycle and that the liquefied refrigerant and lubricating oil stored in the storage casing (41) flows there-outside in the cooling operation.

The refrigerant regulator (4) regulates a circulation amount of the refrigerant in such a manner as to store the liquefied refrigerant and supply an amount of refrigerant according to a storage amount of the liquefied refrigerant through the refrigerant holes (45, 45, . . . ) to the indoor heat exchanger (31) in the cooling operation cycle and in such a manner as to store surplus refrigerant in the heating operation cycle.

In FIG. 3, (F1–F3) show respective filters for removing dust in refrigerant and (ER) shows a silencer for reducing an operation noise of the compressor (21).

Further, there are provided in the air conditioner plural sensors. In detail, disposed at a discharge pipe of the compressor (21) is a discharge-pipe sensor (Thd) for detecting a temperature Td of the discharge pipe. Disposed at an air intake of the outdoor unit (2) is an open-air thermometric sensor (Tha) for detecting a temperature Ta of the outdoor air, i.e., the open air temperature. Disposed at the outdoor heat exchanger (23) is an outdoor heat-exchange sensor (Thc) for detecting a temperature Tc of an outdoor heat exchange which is a condensation temperature in the cooling operation cycle and an evaporation temperature in the heating operation cycle. Disposed at an air intake of the indoor unit (3) is a room temperature sensor (Thr) for detecting a temperature Tr of room air, i.e., a room temperature. Disposed at the indoor heat exchanger (31) is an indoor heat-exchange sensor (The) for detecting a temperature Te of an indoor heat exchange which is an evaporation temperature in the cooling operation cycle and a condensation temperature in the heating operation cycle.

There are disposed at the discharge pipe of the compressor (21) a high-pressure, protection pressure switch (HPS1) which detects a pressure HP of high-pressure refrigerant, turns ON at an excessive rising of the pressure HP and thus outputs a high-pressure protection signal, and a high-pressure-control pressure switch (HPS2) as high-pressure control means which detects a pressure HP of the high-pressure refrigerant, turns ON when the pressure HP reaches to a set value and thus outputs a high-pressure control signal. Disposed at an intake pipe of the compressor (21) is a low-pressure-protection pressure switch (LPS1) which detects a pressure of low-pressure refrigerant, turns ON at an excessive drop of the pressure and thus outputs a low-pressure protection signal.

Output signals from the sensors (Thd, Tha, Thc, Thr, The) and the switches (HPS1, HPS2, LPS1) are inputted to a controller (7). The controller (7) is composed so as to control an air conditioning based on the inputted signals and has capacity control means (71) for the compressor (21), expansion-valve control means (72) and widening control means (73).

The capacity control means (71) is composed so as to divide an operation frequency of the inverter into twenty steps from 0 to a maximum frequency and controls the capacity of the compressor (21), for example, in such a manner as to calculate an optimum value Tk of the discharge-pipe temperature Td which presents an optimum refrigerating effect based on a condensation temperature and an evaporation temperature detected by the outdoor heat-exchange sensor (Thc) and the indoor heat-exchange sensor (The) and set a frequency step N at which the discharge-pipe temperature Td is the optimum value Tk. In other words, the capacity control means (71) is composed so as to execute control based on a discharge-pipe temperature.

The expansion-valve control means (72) is composed so as to execute control based on a discharge-pipe temperature in a similar way to the capacity control means (71). In detail, the expansion-valve control means (72) controls an opening of the motor-operated expansion valve (25) to a reference control opening, for example, in such a manner as to calculate an optimum value Tk of a discharge-pipe temperature Td which presents an optimum refrigerating effect based on a condensation temperature and an evaporation temperature detected by the outdoor heat-exchange sensor (Thc) and the indoor heat-exchange sensor (The) and set a valve opening at which the discharge-pipe temperature Td is the optimum value Tk.

The widening control means (73) is composed so as to output, when the high-pressure-control pressure switch (HPS2) outputs a high-pressure control signal, a widening signal to the expansion-valve control means (72), whereby the expansion-valve control means (72) controls the opening of the motor-operated expansion valve (25) to a compensation opening wider than the reference control opening.

Description is made next about operations at the cooling and heating of the above-mentioned air conditioner.

In the cooling operation cycle, high-pressure refrigerant discharged from the compressor (21) circulates the refrigerant circulating circuit (1) in such a manner as to condense in the outdoor heat exchanger (23) thus liquefying, reduce its pressure through the motor-operated expansion valve (25), flow into the refrigerant regulator (4), evaporate in the indoor heat exchanger (31) and return to the compressor (21). In the heating operation cycle, high-pressure refrigerant discharged from the compressor (21) circulates the refrigerant circulating circuit (1) in such a manner as to condense in the indoor heat exchanger (31) thus liquefying, flow into the refrigerant regulator (4), reduce its pressure through the motor-operated expansion valve (25), evaporate in the outdoor heat exchanger (23) and return to the compressor (21).

In each of the cooling and heating operation cycles, the capacity control means (71) calculates an optimum value Tk of a discharge-pipe temperature Td which presents an optimum refrigerating effect based on a condensation temperature and an evaporation temperature detected by the outdoor heat-exchange sensor (Thc) and the indoor heat-exchange sensor (The), and sets the frequency step N so that the discharge-pipe temperature Td can come to the optimum value Tk, thus controlling the capacity of the compressor (21). The expansion-valve control means (72) sets the reference control opening so that the discharge-pipe temperature Td can come to the optimum value Tk in a similar way to the capacity control means (71), thus controlling the opening of the motor-operated expansion valve (25). This leads to an air conditioning in correspondence with a thermal load in the room.

In the cooling operation cycle, the refrigerant is regulated by the opening of the motor-operated expansion valve (25) and the refrigerant holes (45, 45, . . . ) of the refrigerant regulator (4), in correspondence with a required load by the indoor heat exchanger (31). Thus, a set amount of refrigerant is supplied to the indoor heat exchanger (31).

When a pressure HP of high-pressure refrigerant rises to a set value at a transient time to a steady state in the cooling operation cycle, the high-pressure-control pressure switch (HPS2) outputs a high-pressure control signal. The widening control means (73) receives the high-pressure control signal and then outputs a widening signal to the expansion-valve control means (72). The expansion-valve control means (72) controls the opening of the motor-operated expansion valve (25) to a compensation opening slightly wider than the reference control opening. Thus, liquefied refrigerant which has been stored in the outdoor heat exchanger (23) at the rising of the pressure HP of the high-pressure refrigerant flows into the refrigerant regulator (4). This lowers the pressure HP of the high-pressure refrigerant and stores the liquefied refrigerant in the refrigerant regulator (4). Accordingly, since there cannot be supplied to the indoor heat exchanger (31) liquefied refrigerant more than required, no liquefied refrigerant flows backward though the air conditioner has no accumulator.

In the cooling operation cycle, lubricating oil stored in the refrigerant regulator (4), that is, lubricating oil on the liquefied refrigerant, flows out through the refrigerant holes (45, 45, . . . ) and returns to the compressor (21) via the indoor heat exchanger (31).

On the other hand, in the heating operation cycle, surplus refrigerant is stored in the refrigerant regulator (4). By storing thus the refrigerant in the refrigerant regulator (4), there are prevented a rising of the pressure HP of the high-pressure refrigerant.

As described above, according to this embodiment, the refrigerant regulator (4) is provided between the expansion mechanism (25) and the indoor heat exchanger (31), wherein, in a cooling operation cycle, liquefied refrigerant is stored in the refrigerant regulator (4) and an amount of refrigerant corresponding to an amount of the stored refrigerant is supplied to the indoor heat exchanger (31), and, in the heating operation cycle, liquefied refrigerant is stored in the refrigerant regulator (4). Thus, since it is not required to store the liquefied refrigerant by the use of an accumulator as in the prior art, the accumulator can be considerably minimized or can be dispensed with. Consequently, devices are lessened and a pressure loss is lowered. This enhances running performance of the air conditioner and lowers the cost thereof.

Further, since a circulation amount of refrigerant is regulated by the refrigerant regulator (4), this extends an allowance range of a charge amount of the refrigerant in the refrigerant circulating circuit (1). Consequently, it is not required to change a charge amount of the refrigerant according to a length of the refrigerant piping.

Furthermore, since the air conditioner of the present embodiment does not require a rectification circuit as in the prior art, this dispenses with delivery valves thus reducing the number of elements. Accordingly, the cost of the air conditioner can be lowered.

Since a circulation amount of refrigerant is controlled with high precision by the refrigerant holes (45, 45 . . . ) formed on the second flow pipe (43) of the refrigerant regulator (4), this enhances running performance of the air conditioner.

Further, since the motor-operated expansion valve (25) is widened at a rising of a pressure HP of high-pressure refrigerant, liquefied refrigerant in the outdoor heat exchanger (23) is sent to the refrigerant regulator (4) and then stored therein. This surely lowers the rising of the pressure HP of the high-pressure refrigerant and surely prevents a counter-flow of the liquefied refrigerant and a wet running of the air conditioner. Accordingly, high-reliable operation control of the air conditioner can be executed and an operation range of the air conditioner can be extended.

Figure 5:
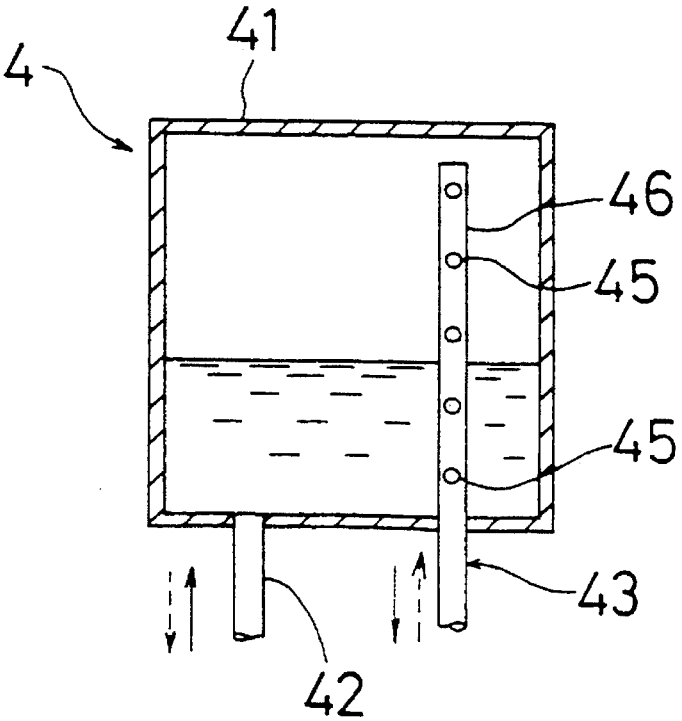
FIG. 5 is an enlarged sectional view showing another refrigerant regulator.

FIG. 5 shows another embodiment of a refrigerant regulator (4) in which an inner pipe portion (46) of a second flow pipe (43) is formed into a straight pipe.

In detail, the second flow pipe (43) is led inside the storage casing (41) through the bottom part thereof. In like manner of the former embodiment, plural refrigerant holes (45, 45 . . . ) are formed on the inner pipe portion (46). Thus, since the second flow pipe (43) of the present embodiment is formed into the straight pipe, this simplifies the production of the air conditioner. Other components, operations and effects are the same as in the former embodiment.

As shown in FIGS. 4 and 5, the aperture means of the refrigerant regulator (4) is formed into the plural refrigerant holes (45, 45, . . . ). In the present invention, however, the aperture means may be a long slit formed on the second flow pipe (43) in a vertical direction thereof, wherein an area of the slit which passes liquefied refrigerant therethrough between the inside of the second flow pipe (43) and the inside of the storage casing (41) increases as a storage amount of the liquefied refrigerant increases.

Figure 6:
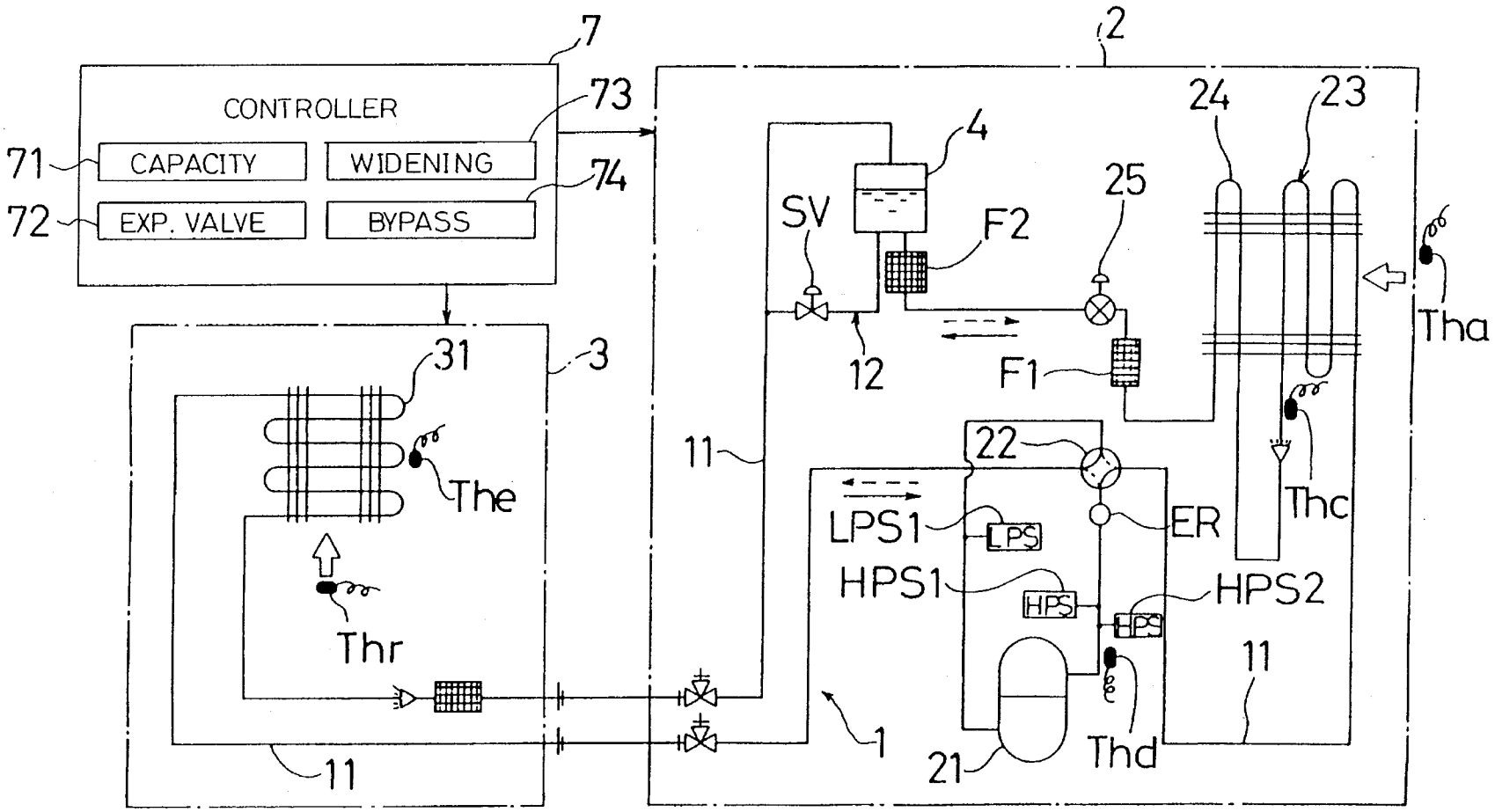
FIG. 6 is a systematic piping diagram showing a second embodiment of a refrigerant circulating circuit of the present invention.

FIG. 6 shows a second embodiment according to claims 13, 14 and 15 of an air conditioner of the present invention, wherein a by-pass line (12) is connected to a refrigerant regulator (4) as in the first embodiment.

The by-pass line (12) has a shut-off valve (SV). An end of the by-pass line (12) is connected to the bottom part of the refrigerant regulator (4) and the other end thereof is connected to refrigerant piping (11) located between a storage casing (41) and an indoor heat exchanger (31).

There is provided in a controller (7) bypass control means (74) for controlling the shut-off valve (SV). The bypass control means (74) controls the shut-off valve (SV) to a wholly closed state in a heating operation cycle and controls the valve (SV) to a wholly opened state in an ordinary cooling operation cycle. When a high-pressure-control pressure switch (HPS2) outputs a high-pressure control signal in a cooling operation cycle, the bypass control means (74) shuts off the shut-off valve (SV). When a discharge-pipe temperature Td detected by a discharge-pipe sensor (Thd) lowers to a set temperature, the bypass control means (74) shuts off the shut-off valve (SV) for a set time.

In detail, for example, when a pressure HP of high-pressure refrigerant reaches to 27 kg/cm$^2$ the high-pressure-control pressure switch (HPS2) turns ON to output a high-pressure control signal. When the pressure HP of the high-pressure refrigerant reaches to 24 kg/cm$^2$ the pressure switch (HPS2) turns OFF to suspend the outputting of the high-pressure control signal. Thus, the bypass control means (74) shuts off the shut-off valve (SV) when the pressure HP of the high-pressure refrigerant reaches to 27 kg/cm$^2$ and opens the valve (SV) when the pressure HP of the high-pressure refrigerant reaches to 24 kg/cm$^2$ Further the bypass control means (74) shuts off the shut-off valve (SV) for ten minutes when the discharge-pipe temperature Td lowers below 60° C.

Accordingly, when the pressure HP of the high-pressure refrigerant rises to a set high pressure in the cooling operation cycle, the motor-operated expansion valve (25) is widened and at the same time the shut-off valve (SV) is shut off, so that liquefied refrigerant is stored in the refrigerant regulator (4). This lowers the pressure HP of the high-pressure refrigerant. Further, when the discharge-pipe temperature Td lowers, the shut-off valve (SV) is shut off so that liquefied refrigerant is stored in the refrigerant regulator (4). This prevents a wet running of the air conditioner.

As a result, since the rising of the pressure HP of the high-pressure refrigerant is prevented and the wet running is surely prevented, high-reliable operation control of the air conditioner can be executed and an operation range thereof can be extended. Other components, operations and effects are the same as in the first embodiment.

Figure 7:
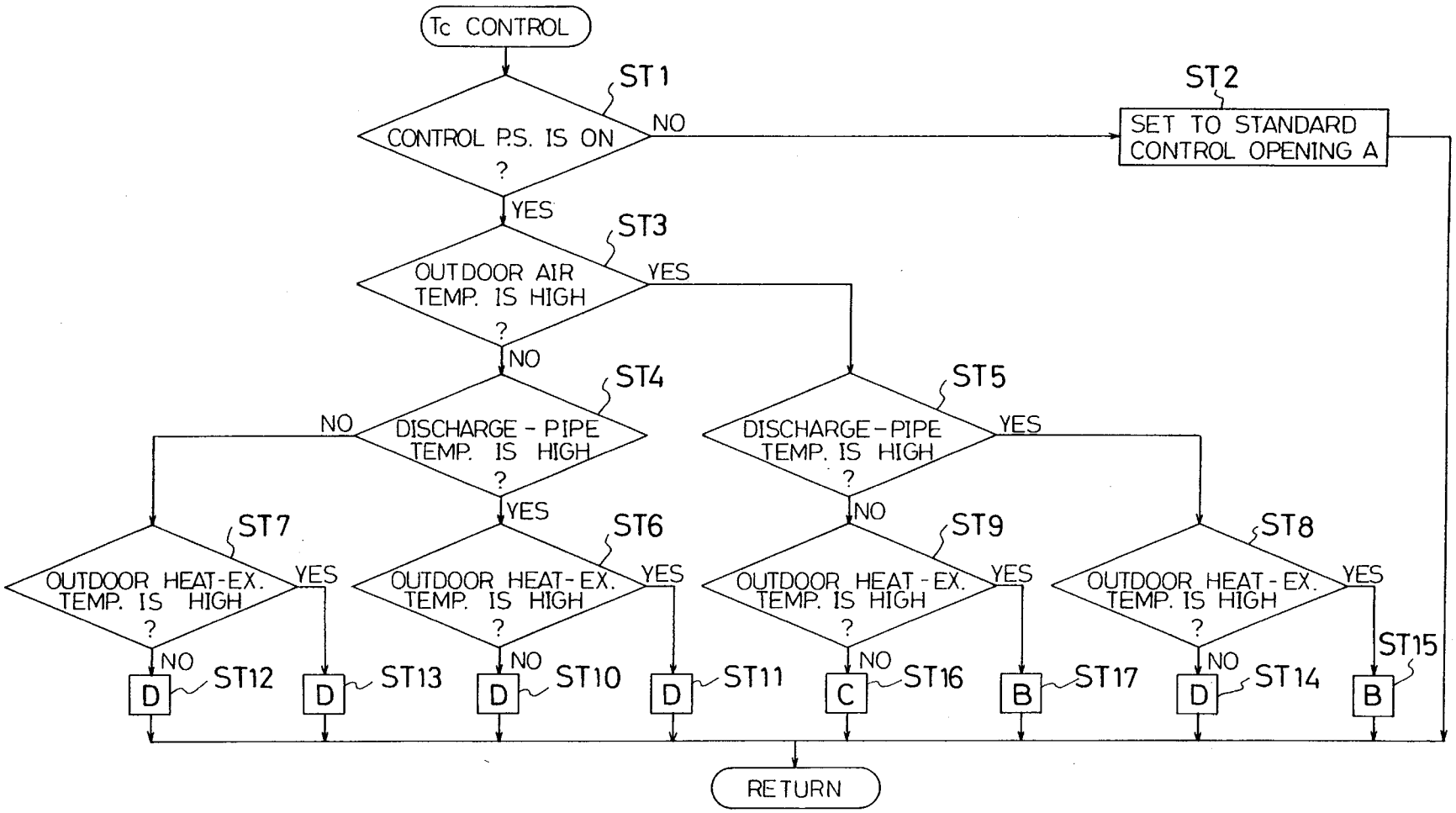
FIG. 7 is a flow chart showing control of a motor-operated expansion valve in a third embodiment of the present invention.

FIG. 7 is a flow chart of control showing a third embodiment according to claims 9 and 12 of an air conditioner of the present invention. In a controller (7) of this embodiment, as shown by dot-dash lines in FIG. 3, supercooling judgment means (75) and opening compensation means (76) are provided in stead of the widening control means (73) in the first embodiment.

The supercooling judgment means (75) judges a supercooling degree of refrigerant in an outdoor heat exchanger (23) in a cooling operation cycle. In detail, when a pressure HP of high-pressure refrigerant to be detected by a high-pressure-control pressure switch (HPS2) rises over a set value and a temperature Ta of the outdoor air to be detected by an open-air thermometric sensor (Tha) reaches to a set temperature, e.g., 30° C. and less, the supercooling judgment means (75) judges that the supercooling degree is high. When the pressure HP of the high-pressure refrigerant to be detected by the high-pressure-control pressure switch (HPS2) rises over a set value and a temperature Tc of an outdoor heat exchange to be detected by an outdoor heat-exchange sensor (Thc) reaches to a set temperature, e.g., 45° C. and less or 40° C. and less, the supercooling judgment means (75) Judges that the supercooling degree is high. Further, when a discharge-pipe temperature Td to be detected by a discharge-pipe sensor (Thd) reaches to a set temperature, e.g., less than 70° C. or less than 80° C., the supercooling judgment means (75) judges the refrigerant to be in a wet state and judges the supercooling degree in consideration of the wet state.

When a pressure HP of high-pressure refrigerant to be detected by the high-pressure-control pressure switch (HPS2) reaches to a set value, e.g., more than 15° C., the opening compensation means (76) outputs, to an expansion-valve control means (72), an opening signal by which the expansion-valve control means (72) controls an opening of a motor-operated expansion valve (25) to a compensation opening wider than a reference control opening and controls so as to widen the compensation opening in accordance with increase of a supercooling degree to be judged by the supercooling judgment means (75).

In detail, the opening compensation means (76) previously memorizes three compensation openings wider than the reference control opening A and outputs, to the expansion-valve control means (72), respective opening signals of the compensation openings which are composed of a first compensation opening D having the greatest opening amount, a second compensation opening C having a medium opening amount and a third compensation opening B having the smallest opening amount, in correspondence with the supercooling degree to be judged by the supercooling judgment means (75).

Description is made next about an operation of compensating an opening of the motor-operated expansion valve (25) in the cooling operation cycle, with reference to a flow chart of control shown in FIG. 7.

When a routine for compensating an opening of the motor-operated expansion valve (25) starts, there is judged at a step ST1 whether the high-pressure-control pressure switch (HPS2) is ON. The high-pressure-control pressure switch (HPS2) turns ON when a pressure HP of high-pressure refrigerant is, for example, over 15 kg/cm$^2$ Accordingly, the judgment at the step ST1 is NO till the high-pressure-control pressure switch (HPS2) turns ON and the sequence is moved to a step ST2. At the step ST2, the expansion-valve control means (72) controls the opening of the motor-operated expansion valve (25) to the reference control opening A in order that a discharge-pipe temperature Td can come to an optimum value Tk. Then, the sequence is returned.

On the other hand, when the high-pressure-control pressure switch (HPS2) turns 0N, the sequence is moved from the step ST1 to a step ST3. At the step ST3, there is judged whether a temperature Ta of the outdoor air to be detected by the open-air thermometric sensor (Tha) is, for example, over 30° C. When the temperature Ta is not over 30° C., the sequence is moved to a step ST4. When the temperature Ta is over 30° C., the sequence is moved to a step ST5. At the step ST4, there is judged whether a discharge-pipe temperature Td to be detected by the discharge-pipe sensor (Thd) is a high temperature of, for example, 70° C. and more. When the discharge-pipe temperature Td is 70° C. and more, there is judged that the refrigerant is not in a wet state. Then, the sequence is moved to a step ST6. When the discharge-pipe temperature Td is below 70° C., there is Judged that the refrigerant is in a wet state. Then, the sequence is moved to a step ST7. At the step ST5, there is judged whether a discharge-pipe temperature Td to be detected by the discharge-pipe sensor (Thd) is a high temperature of, for example, 80° C. and more. When the temperature Td is 80 and more, there is judged that the refrigerant is not in a wet state. Then, the sequence is moved to a step ST8. When the temperature Td is below 80° C., there is Judged that the refrigerant is in a wet state. Then, the sequence is moved to a step ST9.

Further, at each of the steps ST6 and ST7, there is judged whether a temperature Tc of the outdoor heat exchange to be detected by the outdoor heat-exchange sensor (Thc) is, for example, over 40° C. When the temperature Tc is 40° C. and less, the sequence is moved to a step ST10 or a step ST12 and then returned. When the temperature Tc is over 40° C., the sequence is moved to a step ST11 or a step ST13 and then returned. At each of the steps ST8 and ST9, there is judged whether the temperature Tc of the outdoor heat exchange to be detected by the outdoor heat-exchange sensor (Thc) is, for example, over 45° C. When the temperature Tc is 45° C. and less, the sequence is moved to a step ST14 or a step ST16 and then returned. When the temperature Tc is over 45° C., the sequence is moved to a step ST15 or a step ST17 and then returned.

At the steps ST10–ST13, since it is considered that the rising of the pressure HP of the high-pressure refrigerant results from increase of a supercooling degree owing to lowness of the temperature Ta of the outdoor air, the opening of the motor-operated expansion valve (25) is set to the first compensation opening D which is wider than the reference control opening A and has the greatest opening amount.

At the steps ST14–ST17, since the temperature Ta of the outside air is slightly low, a supercooling degree is judged based on the temperature Tc of the outdoor heat exchange. When the temperature Tc of the outdoor heat exchange is over 45° C., the pressure HP of the high-pressure refrigerant rises in a state that the supercooling degree is low. Accordingly, at the steps ST15 and ST17, the opening of the motor-operated expansion valve (25) is set to the third compensation opening B which is wider than the reference control opening A and has the smallest opening amount. Further, when the discharge-pipe temperature Td is below 80° C. and the temperature Tc of the outdoor heat exchange is 45° C. and less, there can be judged that the refrigerant is in a wet state. Accordingly, at the step ST16, in spite of the rising of the pressure HP of the high-pressure refrigerant, the opening of the motor-operated expansion valve (25) is set to the second compensation opening C which is wider than the reference control opening A and has the medium opening amount. When the discharge-pipe temperature Td is 80° C. and more and the temperature Tc of the outdoor heat exchange is 45° C. and less, it is considered that the increase of the supercooling degree results in the rising of the pressure HP of the high-pressure refrigerant. Accordingly, at the step ST14, the opening of the motor-operated expansion valve (25) is set to the first compensation opening D which is wider than the reference control opening A and has the greatest opening amount.

The supercooling judgment means (75) is composed of the steps ST1 and ST3–ST9. The opening compensation means (76) is composed of the steps ST10–ST17.

As a result, liquefied refrigerant which has been stored in the outdoor heat exchanger (23) at the rising of the pressure HP of the high-pressure refrigerant flows into the refrigerant regulator (4) so that the pressure HP lowers and the liquefied refrigerant is stored in the refrigerant regulator (4).

Consequently, according to the present embodiment, the rising of the pressure HP of the high-pressure refrigerant is prevented in such a manner that the opening of the motor-operated expansion valve (25) is widened large according to an amount of the liquefied refrigerant stored in the outdoor heat exchanger (23), that is, according to a supercooling degree. This presents high-precise running of the air conditioner, enhances an energy effective ratio (EER) thereof and extends an operation range thereof.

Further, since no sensor to be exclusively used for judgment of the supercooling degree is required, the rising of the pressure HP of the high-pressure refrigerant is prevented without complicating a structure of the air conditioner.

Figure 8:
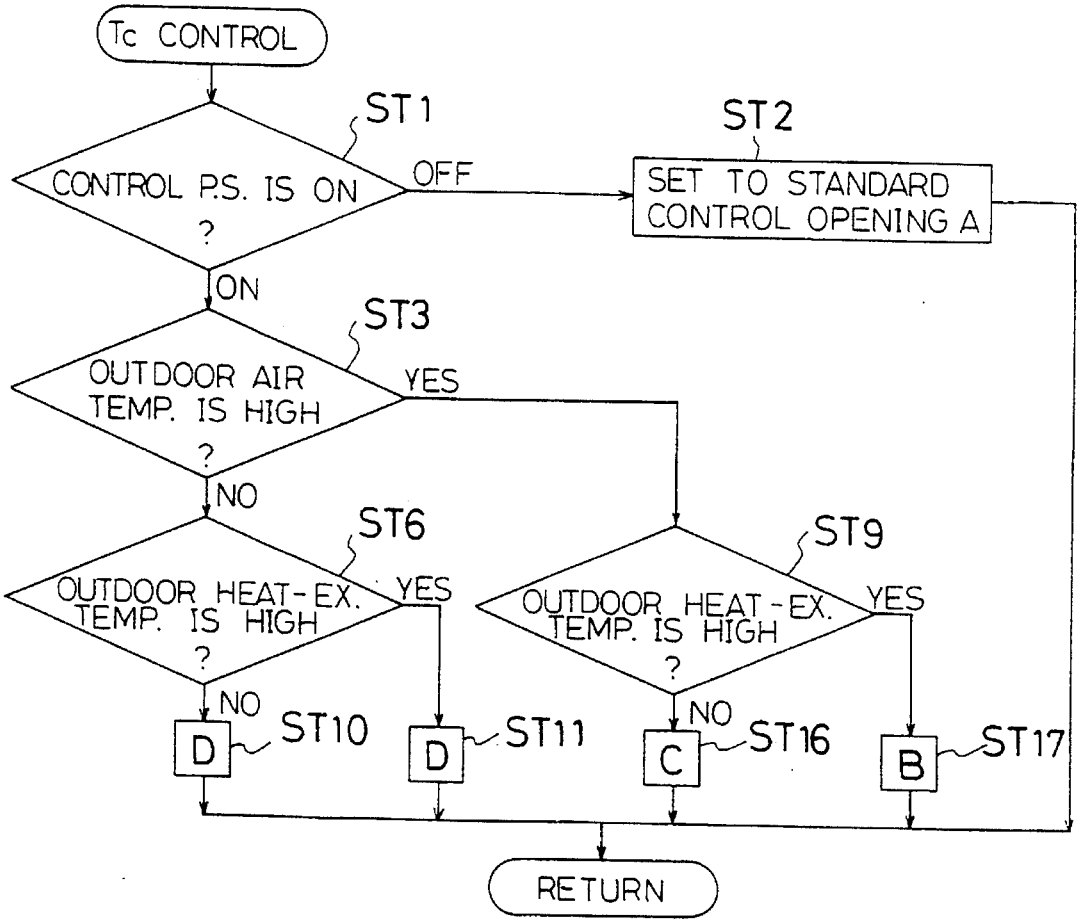
FIG. 8 is a flow chart showing a modified example of control of the motor-operated expansion valve.

FIG. 8 shows an embodiment according to claim 11 of an air conditioner of the present invention. In this embodiment, the steps ST4 and ST5 are omitted from the embodiment shown in FIG. 7 and no judgment is made with relation to a discharge-pipe temperature Td.

Accordingly, the sequence is moved from the step ST3 to the steps ST6 or ST9. At the step ST6, there is judged whether a temperature Tc of an outdoor heat exchange to be detected by the outdoor heat-exchange sensor (Thc) is, for example, over 40° C. When the temperature Tc is 40° C. and less, the sequence is moved to the step ST10 and then returned. When the temperature Tc is over 40° C., the sequence is moved to the step ST11 and then returned. At the step ST9, there is judged whether the temperature Tc of the outdoor heat exchange to be detected by the outdoor heat-exchange sensor (Thc) is, for example, over 45° C. When the temperature Tc is 45° C. and less, the sequence is moved to the step ST16 and then returned. When the temperature Tc is over 45° C., the sequence is moved to the step ST17 and then returned.

At the steps ST10 and ST11, since it is considered that the rising of the pressure HP of the high-pressure refrigerant results from increase of a supercooling degree owing to lowness of the temperature Ta of the outdoor air, the opening of the motor-operated expansion valve (25) is set to the first compensation opening D which is wider than the reference control opening A and has the greatest opening amount.

At the steps ST16 and ST17, since the temperature Ta of the outdoor air is slightly low, a supercooling degree is judged based on the temperature Tc of the outdoor heat exchange. When the temperature Tc of the outdoor heat exchange is over 45° C., the pressure HP of the high-pressure refrigerant rises in a state that the supercooling degree is low. Accordingly, at the step ST17, the opening of the motor-operated expansion valve (25) is set to the third compensation opening B which is wider than the reference control opening A and has the smallest opening amount. Further, when the temperature Tc of the outdoor heat exchange is 45° C. and less, there can be judged that the refrigerant is in a wet state. Accordingly, at the step ST16, in spite of the rising of the pressure HP of the high-pressure refrigerant, the opening of the motor-operated expansion valve (25) is set to the second compensation opening C. which is wider than the reference control opening A and has the medium opening amount.

Other components, operations and effects is the same as in the embodiment shown in FIG. 7.

Figure 9:
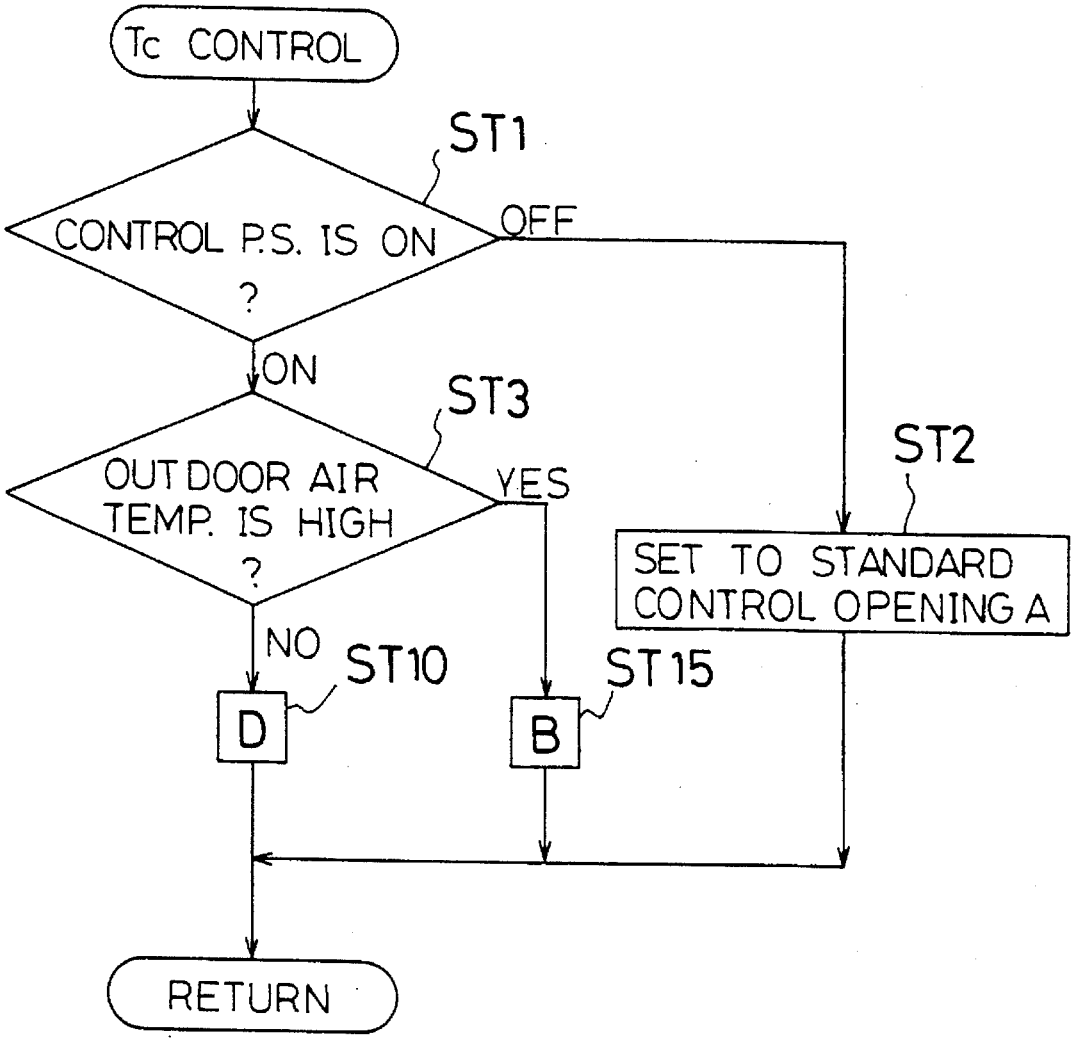
FIG. 9 is a flow chart showing another modified example of control of the motor-operated expansion valve.

FIG. 9 shows an embodiment according to claim 10 of an air conditioner of the present invention. In this embodiment, the steps ST4–ST9 are omitted from the embodiment shown in FIG. 7 and judgment is made with relation to only a temperature Ta of an outdoor air and no judgment is made with relation to a discharge-pipe temperature Td and a temperature Tc of an outdoor heat exchange.

Accordingly, the sequence is moved from the step ST3 to the step ST10 or the step ST15. In detail, at the step ST3, there is judged whether the temperature Ta of the outdoor air to be detected by the open-air thermometric sensor (Tha) is over 30° C. When the temperature Ta is 30° C. and less, the sequence is moved to the step ST10 and then returned. When the temperature Ta is over 30° C., the sequence is moved to the step ST15 and then returned. At the step ST10, since it is considered that the rising of the pressure HP of the high-pressure refrigerant results from increase of a supercooling degree owing to lowness of the temperature Ta of the outdoor air, the opening of the motor-operated expansion valve (25) is set to the first compensation opening D which is wider than the reference control opening A and has the greatest opening amount.

At the step ST15, since the temperature Ta of the outdoor air is slightly low, the opening of the motor-operated expansion valve (25) is set to the third compensation opening B which is wider than the reference control opening A and has the smallest opening amount.

Other components, operations and effects are the same as in the embodiment shown in FIG. 7.

Figure 10:
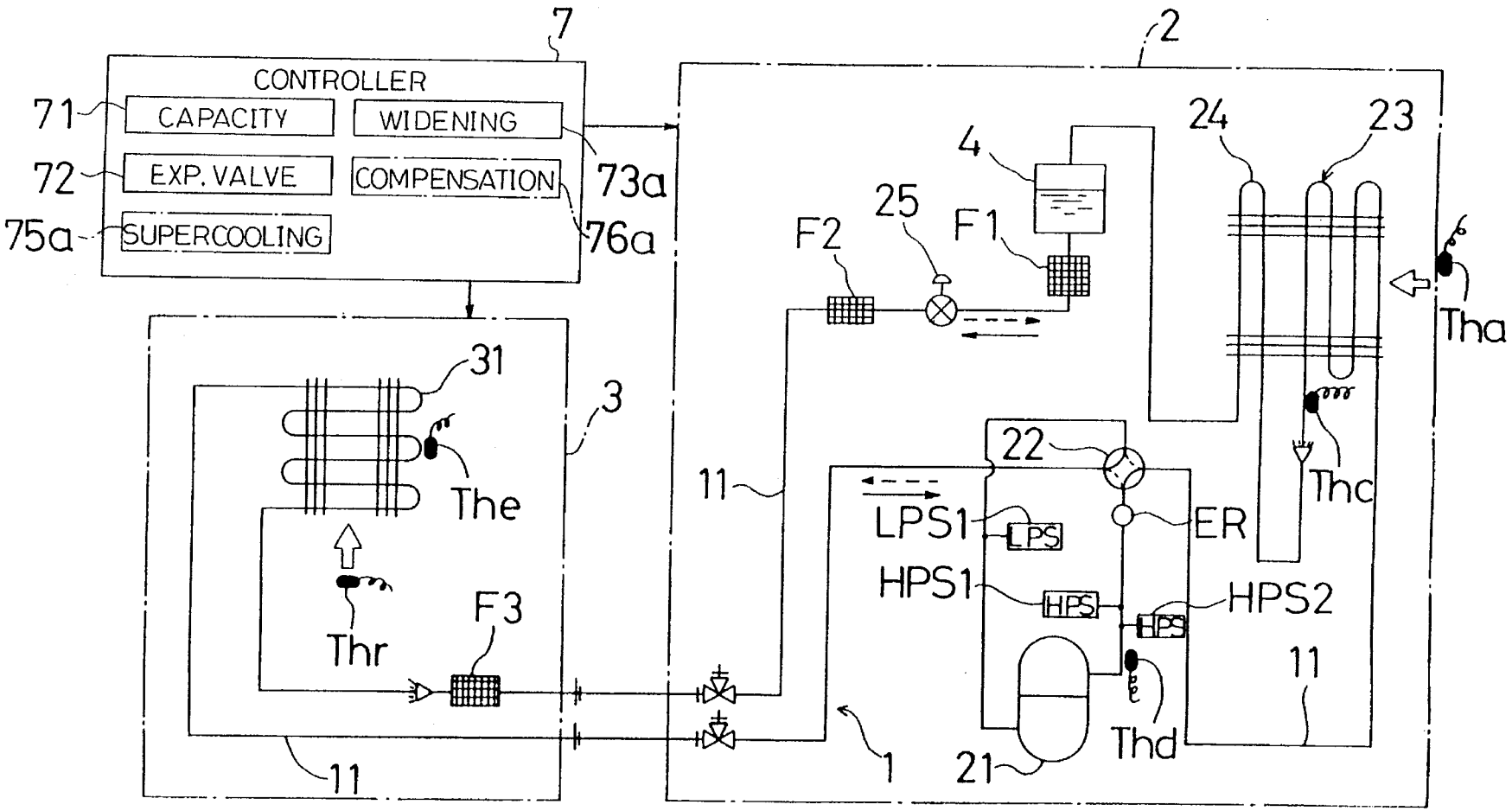
FIG. 10 is a systematic piping diagram showing a refrigerant circulating circuit in a fourth embodiment of the present invention.

FIG. 10 shows a system of refrigerant piping in a fourth embodiment according to claims 2, 4, 5, 7 and 16 of an air conditioner of the present invention. In this embodiment, the motor-operated expansion valve (25) and the refrigerant regulator (4) of the first embodiment shown in FIG. 3 are disposed reversely to each other.

In detail, the refrigerant regulator (4) is interposed in refrigerant piping (11) which is a line for high-pressure liquefied refrigerant in a cooling operation cycle and for low-pressure liquefied refrigerant in a heating operation cycle and which is located between an auxiliary heat exchanger (24) of an outdoor heat exchanger (23) and a motor-operated expansion valve (25). A first flow pipe (42) of the refrigerant regulator (4) as shown in FIG. 4 is connected to the refrigerant piping (11) toward an indoor heat exchanger (31) and a second flow pipe (43) as shown in FIG. 4 is connected to the refrigerant piping (11) toward the outdoor heat exchanger (23).

The refrigerant regulator (4) is composed so as to store surplus refrigerant in the cooling operation cycle and, in the heating operation cycle, store liquefied refrigerant and supply an amount of refrigerant corresponding to the storage amount of the liquefied refrigerant to the outdoor heat exchanger (23) through plural refrigerant holes (45, 45 . . . ) (In FIG. 4, a solid line and a broken line indicate the heating operation cycle and the cooling operation cycle respectively).

As shown by a solid line in FIG. 10, in the cooling operation cycle, high-pressure refrigerant discharged from a compressor (21) circulates a refrigerant circulating circuit (1) in such a manner as to condense in the outdoor heat exchanger (23) thus liquefying, flow into the refrigerant regulator (4), reduce its pressure through the motor-operated expansion valve (25), evaporate in the indoor heat exchanger (31) and return to the compressor (21).

As shown by a broken line in FIG. 10, in the heating operation cycle, high-pressure refrigerant discharged from the compressor (21) circulates the refrigerant circulating circuit (1) in such a manner as to condense in the indoor heat exchanger (31) thus liquefying, reduce its pressure through the motor-operated expansion valve (25), flow into the refrigerant regulator (4), evaporate in the outdoor heat exchanger (23) and return to the compressor (21).

In like manner of the embodiment shown in FIG. 3, there is provided in a controller (7) capacity control means (71), expansion-valve control means (72) and widening control means (73*a*).

In detail, when a pressure HP of high-pressure refrigerant rises to a set value at a transient time to a steady state in the heating operation cycle, a high-pressure-control pressure switch (HPS2) outputs a high-pressure control signal. The widening control means (73*a*) receives the high-pressure control signal and then outputs a widening signal to the expansion-valve control means (72). The expansion-valve control means (72) controls the opening of the motor-operated expansion valve (25) to a compensation opening slightly wider than a reference control opening. Thus, liquefied refrigerant which has been stored in the outdoor heat exchanger (23) at the rising of the pressure HP of the high-pressure refrigerant flows into the refrigerant regulator (4). This lowers the pressure HP of the high-pressure refrigerant and stores the liquefied refrigerant in the refrigerant regulator (4). Accordingly, since there cannot be supplied to the outdoor heat exchanger (23) liquefied refrigerant more than required, liquefied refrigerant does not flow backward though the air conditioner has no accumulator.

In the heating operation cycle, lubricating oil stored in the refrigerant regulator (4), that is, lubricating oil on the liquefied refrigerant, flows out through the refrigerant holes (45, 45, . . . ) and returns to the compressor (21) via the outdoor heat exchanger (23).

On the other hand, in the cooling operation cycle, surplus refrigerant is stored in the refrigerant regulator (4). By storing thus the refrigerant in the refrigerant regulator (4), there is prevented a rising of the pressure HP of the high-pressure refrigerant. Other components and operations are the same as in the first embodiment shown in FIG. 3.

According to this embodiment, as in the case of the first embodiment shown in FIG. 3, an accumulator can be considerably minimized or can be dispensed with. Consequently, devices are lessened and a pressure loss is lowered. This enhances a running performance of the air conditioner and lowers the cost thereof.

Further, since a circulation amount of refrigerant is regulated by the refrigerant regulator (4), this widens an allowance range of a charge amount of the refrigerant in the refrigerant circulating circuit (1). Consequently, it is not required to change a charge amount of the refrigerant according to a length of the refrigerant piping.

Furthermore, since the air conditioner of the present embodiment does nor require a rectification circuit as in the prior art, this dispenses with delivery valves thus reducing the number of elements. Accordingly, the cost of the air conditioner can be lowered.

Since a circulation amount of refrigerant is controlled with high precision by the plural refrigerant holes (45, 45 . . . ) formed on the second flow pipe (43) of the refrigerant regulator (4), this enhances running performance of the air conditioner.

Further, since the motor-operated expansion valve (25) is widened at a rising of a pressure HP of the high-pressure refrigerant, liquefied refrigerant in the outdoor heat exchanger (23) is sent to the refrigerant regulator (4) and then stored therein. This surely lowers the rising of the pressure HP of the high-pressure refrigerant and surely prevents a counter-flow of the liquefied refrigerant and a wet running of the air conditioner. Accordingly, high-reliable operation control of the air conditioner can be executed and an operation range thereof can be extended.

Also in the present embodiment, the aperture means is plural holes (45, 45, . . . ) formed on the second flow pipe (43) of the refrigerant regulator (4). However, the aperture means may be a long slit or the like.

Figure 11:
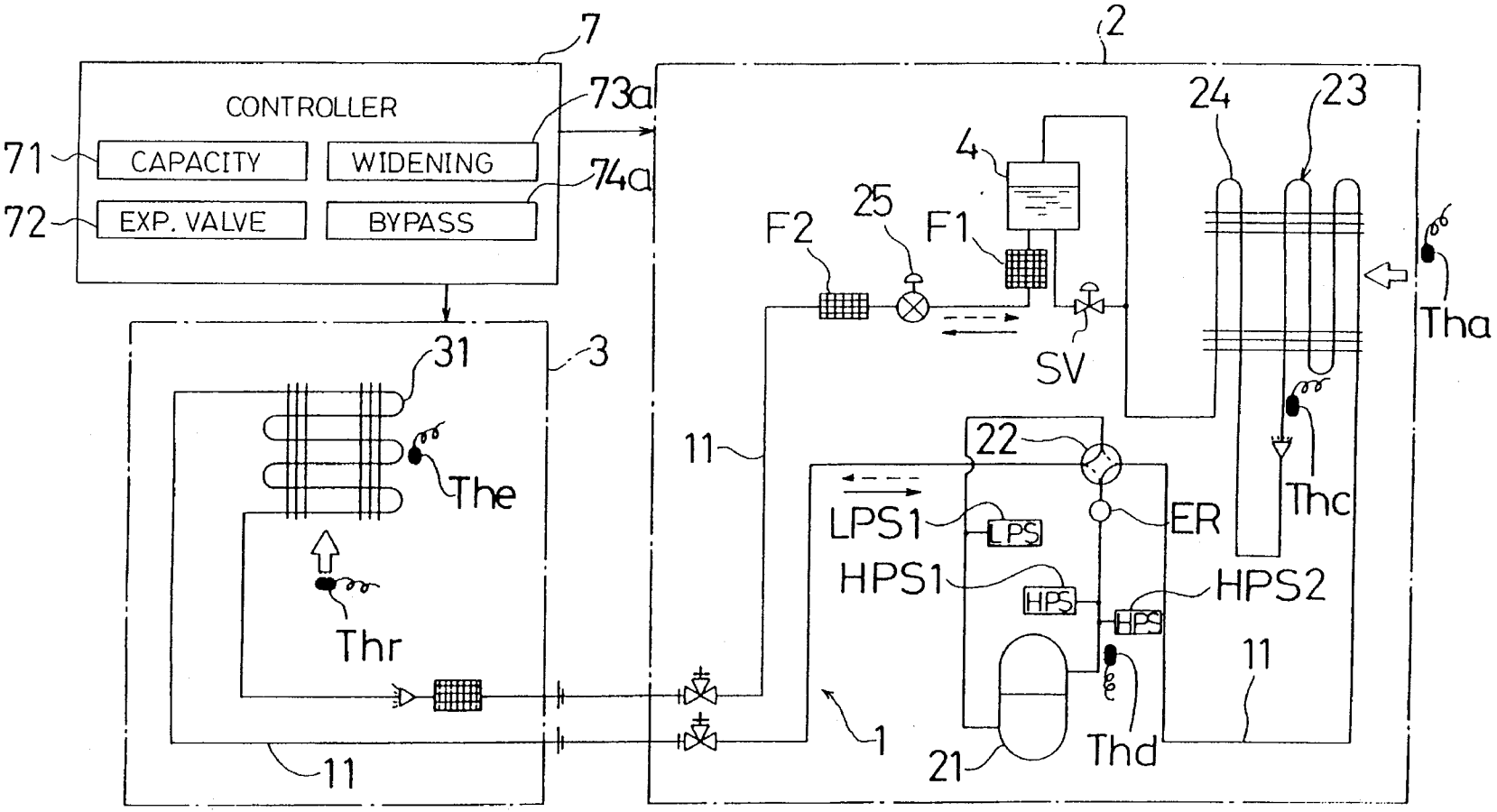
FIG. 11 is a systematic piping diagram showing a refrigerant circulating circuit in a fifth embodiment of the present invention.

FIG. 11 shows a fifth embodiment according to claims 21, 22 and 23 of an air conditioner of the present invention. This embodiment corresponds to the second embodiment shown in FIG. 6. In this embodiment, a by-pass line (12) is connected to a refrigerant regulator (4) as in the fourth embodiment.

The by-pass line (12) has a shut-off valve (SV). An end of the by-pass line (12) is connected to a bottom part of the refrigerant regulator (4) and the other end thereof is connected to refrigerant piping (11) located between a storage casing (41) and an outdoor heat exchanger (23).

There is provided in a controller (7) bypass control means (74*a*) for controlling the shut-off valve (SV). The bypass control means (74*a*) controls the shut-off valve (SV) to a wholly closed state in a cooling operation cycle and controls the shut-off valve (SV) to a wholly opened state in an ordinary heating operation cycle. When a high-pressure-control pressure switch (HPS2) outputs a high-pressure control signal in a heating operation cycle, the bypass control means (74*a*) shuts off the shut-off valve (SV). When a discharge-pipe temperature Td detected by a discharge-pipe sensor (Thd) lowers to a set temperature, the bypass control means (74*a*) shuts off the shut-off valve (SV) for a set time.

Accordingly, when a pressure HP of high-pressure refrigerant rises to a set high pressure in the heating operation cycle, the motor-operated expansion valve (25) is widened and at the same time the shut-off valve (SV) is shut off, so that liquefied refrigerant is stored in the refrigerant regulator (4). This lowers the pressure HP of the high-pressure refrigerant. Further, when the discharge-pipe temperature Td lowers, the shut-off valve (SV) is shut off so that liquefied refrigerant is stored in the refrigerant regulator (4). This prevents a wet running of the air conditioner.

As a result, since the rising of the pressure HP of the high-pressure refrigerant is prevented and the wet running is surely prevented, high-reliable operation control of the air conditioner can be executed and an operation range thereof can be extended. Other components, operations and effects are the same as in the fourth embodiment.

Figure 12:
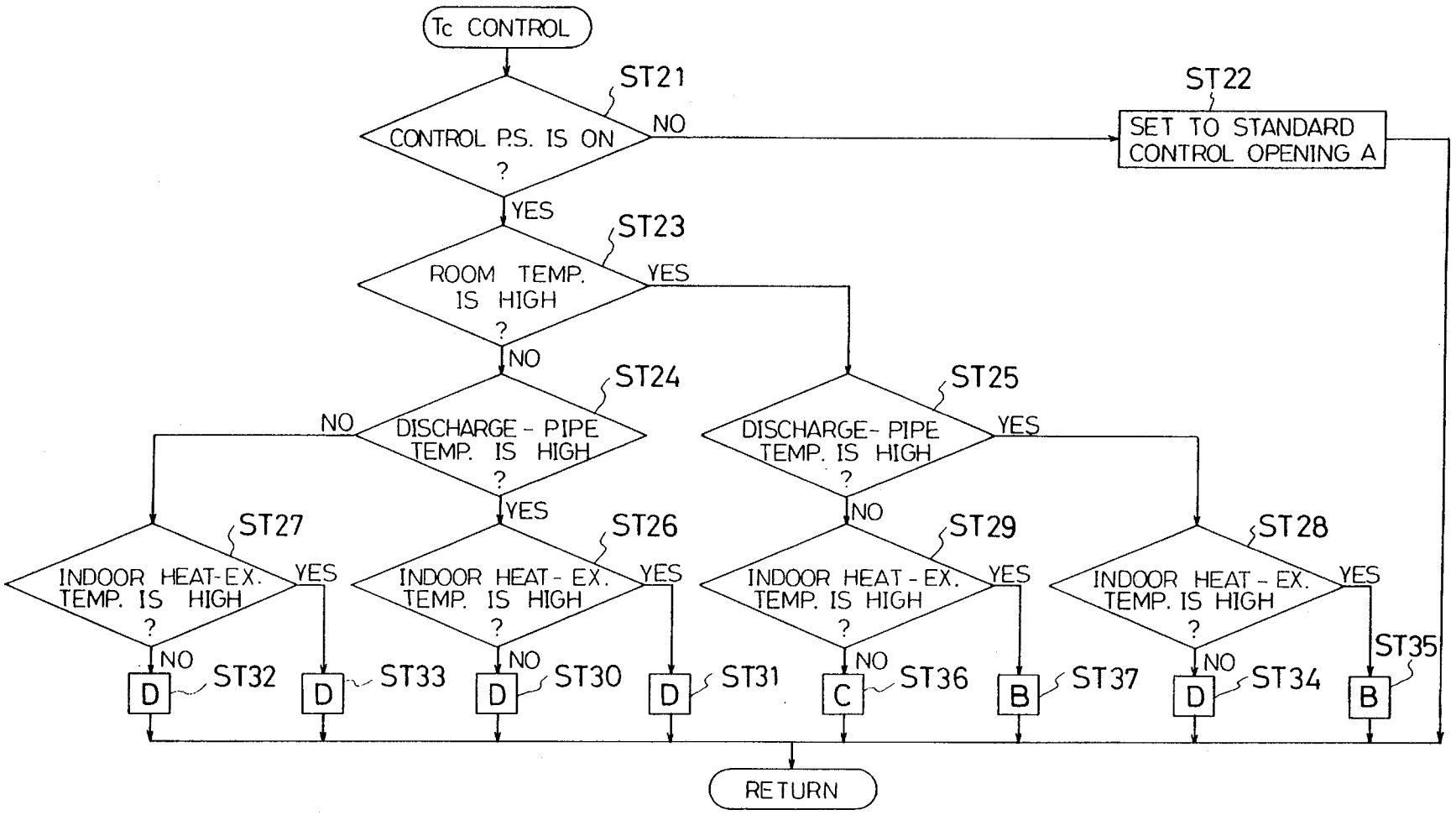
FIG. 12 is a flow chart showing control of a motor-operated expansion valve in a sixth embodiment of the present invention.

FIG. 12 is a flow chart of control showing a sixth embodiment according to claims 17 and 20 of an air conditioner of the present invention. This embodiment corresponds to the third embodiment shown in FIG. 7. In a controller (7) of this embodiment, as shown by dot-dash lines in FIG. 10, supercooling judgment means (75*a*) and opening compensation means (76*a*) are provided in stead of the widening control means (73*a*) in the fourth embodiment.

The supercooling judgment means (75*a*) judges a supercooling degree of refrigerant in an indoor heat exchanger (31) in a heating operation cycle. When a pressure HP of high-pressure refrigerant to be detected by a high-pressure-control pressure switch (HPS2) rises over a set value and a temperature Tr of room air to be detected by a room temperature sensor (Thr) reaches to a set temperature, the supercooling judgment means (75*a*) judges that the supercooling degree is high. When the pressure HP of the high-pressure refrigerant to be detected by the high-pressure-control pressure switch (HPS2) rises over a set value and a temperature Te of an indoor heat exchange to be detected by an indoor heat-exchange sensor (The) reaches to a set temperature, the supercooling judgment means (75*a*) judges that the supercooling degree is high. Further, when a discharge-pipe temperature Td to be detected by a discharge-pipe sensor (Thd) reaches to a set temperature, the supercooling judgment means (75*a*) judges the refrigerant to be in a wet state and judges the supercooling degree in consideration of the wet state.

When a pressure HP of the high-pressure refrigerant to be detected by the high-pressure-control pressure switch (HPS2) reaches to a set value, the opening compensation means (76*a*) outputs, to an expansion-valve control means (72), an opening signal by which the expansion-valve control means (72) controls an opening of a motor-operated expansion valve (25) to a compensation opening wider than a reference control opening and controls so as to widen the compensation opening in accordance with increase of a supercooling degree to be judged by the supercooling judgment means (75*a*).

In detail, the opening compensation means (76*a*) previously memorizes three compensation openings wider than the reference control opening and outputs, to the expansion-valve control means (72), respective opening signals of the compensation openings which are composed of a first compensation opening D having the greatest opening amount, a second compensation opening C having a medium opening amount and a third compensation opening B having the smallest opening amount, in correspondence with the supercooling degree to be judged by the supercooling judgment means (75*a*).

Description is made next about an operation of compensating an opening of the motor-operated expansion valve (25) in the heating operation cycle, with reference to a flow chart of control shown in FIG. 12.

When a routine for compensating an opening of the motor-operated expansion valve (25) starts, there is judged at a step ST21 whether the high-pressure-control pressure switch (HPS2) is 0N. Until the high-pressure-control pressure switch (HPS2) turns 0N, the judgment is NO. In this case, the sequence is moved to a step ST22. At the step ST22, the expansion-valve control means (72) controls the opening of the motor-operated expansion valve (25) to the reference control opening A in order that a discharge-pipe temperature Td can come to an optimum value Tk. Then, the sequence is returned.

On the other hand, when the high-pressure-control pressure switch (HPS2) turns 0N, the sequence is moved from the step ST21 to a step ST23. At the step ST23, there is judged whether a temperature Tr of room air to be detected by the room temperature sensor (Thr) is over a set temperature. When the temperature Tr is not over the set temperature, the sequence is moved to a step ST24. When the temperature Tr is over the set temperature, the sequence is moved to a step ST25. At the step ST24, there is judged whether a discharge-pipe temperature Td to be detected by the discharge-pipe sensor (Thd) is a high temperature of a set temperature and more. When the discharge-pipe temperature Td is the set temperature and more, there is judged that the refrigerant is not in a wet state. Then, the sequence is moved to a step ST26. When the discharge-pipe temperature Td is below the set temperature, there is judged that the refrigerant is in a wet state. Then, the sequence is moved to a step ST27. At the step ST25, there is judged whether a discharge-pipe temperature Td to be detected by the discharge-pipe sensor (Thd) is a high temperature of a set temperature and more. When the temperature Td is the set temperature and more, there is judged that the refrigerant is not in a wet state. Then, the sequence is moved to a step ST28. When the temperature Td is below the set temperature, there is judged that the refrigerant is in a wet state. Then, the sequence is moved to a step ST29.

Further, at each of the steps ST26 and ST27, there is judged whether a temperature Te of an indoor heat exchange to be detected by the indoor heat-exchange sensor (The) is over a set temperature. When the temperature Te is the set temperature and less, the sequence is moved to a step ST30 or a step ST32 and then returned. When the temperature Tc is over the set temperature, the sequence is moved to a step ST31 or a step ST33 and then returned. At each of the steps ST28 and ST29, there is judged whether the temperature Te of the indoor heat exchange to be detected by the indoor heat-exchange sensor (The) is over a set temperature. When the temperature Te is the set temperature and less, the sequence is moved to a step ST34 or a step ST36 and then returned. When the temperature Te is over the set temperature, the sequence is moved to a step ST35 or a step ST37 and then returned.

At the steps ST30–ST33, since it is considered that the rising of the pressure HP of the high-pressure refrigerant results from increase of a supercooling degree owing to lowness of the temperature Tr of room air, the opening of the motor-operated expansion valve (25) is set to the first compensation opening D which is wider than the reference control opening A and has the greatest opening amount.

At the steps ST34–ST37, since the temperature Tr of room air is slightly low, a supercooling degree is judged based on the temperature Te of the indoor heat exchange. When the temperature Te of the indoor heat exchange is over the set temperature, the pressure HP of the high-pressure refrigerant rises in a state that the supercooling degree is low. Accordingly, at the steps ST35 and ST37, the opening of the motor-operated expansion valve (25) is set to the third compensation opening B which is wider than the reference control opening A and has the smallest opening amount.

Further, when the discharge-pipe temperature Td is below the set temperature and the temperature Te of the indoor heat exchange is the set temperature and less, there can be judged that the refrigerant is in a wet state. Accordingly, at the step ST36, in spite of the rising of the pressure HP of the high-pressure refrigerant, the opening of the motor-operated expansion valve (25) is set to the second compensation opening C which is wider than the reference control opening A and has the medium opening amount. When the discharge-pipe temperature Td is the set temperature and more and the temperature Te of the indoor heat exchange is the set temperature and less, it is considered that the increase of the supercooling degree results in the rising of the pressure HP of the high-pressure refrigerant. Accordingly, at the step ST34, the opening of the motor-operated expansion valve (25) is set to the first compensation opening D which is wider than the reference control opening A and has the greatest opening amount.

The supercooling judgment means (75*a*) is composed of the steps ST21 and ST23–ST29. The opening compensation means (76*a*) is composed of the steps ST30–ST37.

As a result, liquefied refrigerant which has been stored in the indoor heat exchanger (31) at the rising of the pressure HP of the high-pressure refrigerant flows into the refrigerant regulator (4), so that the pressure HP lowers and the liquefied refrigerant is stored in the refrigerant regulator (4).

Consequently, according to the present embodiment, the rising of the pressure HP of the high-pressure refrigerant is prevented in such a manner that the opening of the motor-operated expansion valve (25) is widened large according to an amount of the liquefied refrigerant stored in the indoor heat exchanger (31), that is, according to a supercooling degree. This presents high-precise running of the air conditioner, enhances an energy effective ratio (EER) thereof and extends an operation range thereof.

Further, since no sensor to be exclusively used for judgment of the supercooling degree is required, the rising of the pressure HP of the high-pressure refrigerant is prevented without complicating a structure of the air conditioner.

Figure 13:
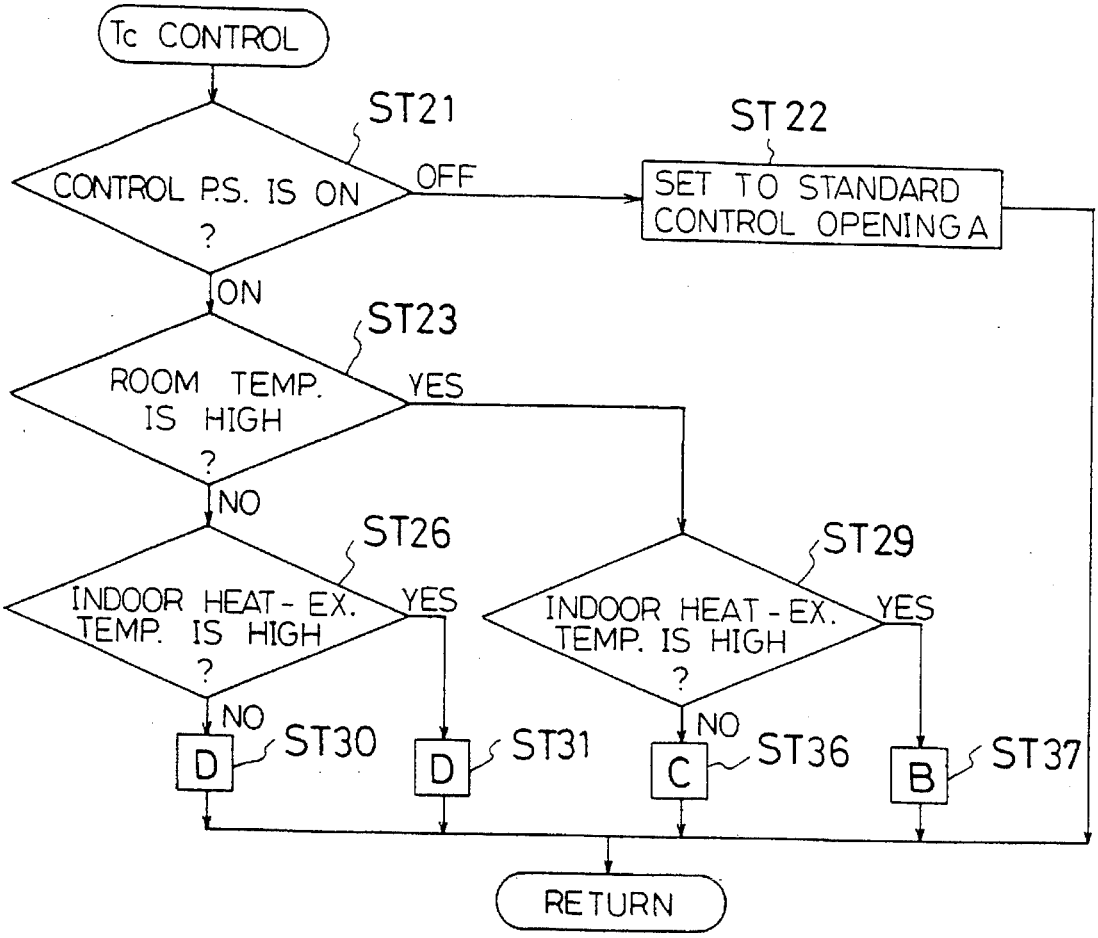
FIG. 13 is a flow chart showing a modified example of control of the motor-operated expansion valve.

FIG. 13 shows an embodiment according to claim 19 of an air conditioner of the present invention. In this embodiment, the steps ST24 and ST25 are omitted from the embodiment shown in FIG. 12 and no judgment is made with relation to the discharge-pipe temperature Td.

Accordingly, the sequence is moved from the step ST23 to the steps ST26 or ST29. At the step ST26, there is judged whether a temperature Te of an indoor heat exchange to be detected by the indoor heat-exchange sensor (The) is over a set temperature. When the temperature Te is the set temperature and less, the sequence is moved to the step ST30 and then returned. When the temperature Te is over the set temperature, the sequence is moved to the step ST31 and then returned.

At the step ST29, there is judged whether the temperature Te of the indoor heat exchange to be detected by the indoor heat-exchange sensor (The) is over a set temperature. When the temperature Te is the set temperature and less, the sequence is moved to the step ST36 and then returned. When the temperature Te is over the set temperature, the sequence is moved to the step ST37 and then returned.

At the steps ST30 and ST31, since it is considered that the rising of the pressure HP of the high-pressure refrigerant results from increase of a supercooling degree owing to lowness of the temperature Tr of room air, the opening of the motor-operated expansion valve (25) is set to the first compensation opening D which is wider than the reference control opening A and has the greatest opening amount.

At the steps ST36 and ST37, since the temperature Tr of room air is slightly low, a supercooling degree is judged based on the temperature Te of the indoor heat exchange. When the temperature Te of the indoor heat exchange is over the set temperature, the pressure HP of the high-pressure refrigerant rises in a state that the supercooling degree is low. Accordingly, at the step ST37, the opening of the motor-operated expansion valve (25) is set to the third compensation opening B which is wider than the reference control opening A and has the smallest opening amount. Further, when the temperature Te of the indoor heat exchange is the set temperature and less, there can be judged that the refrigerant is in a wet state. Accordingly, at the step ST36, in spite of the rising of the pressure HP of the high-pressure refrigerant, the opening of the motor-operated expansion valve (25) is set to the second compensation opening C which is wider than the reference control opening A and has the medium opening amount.

Other components, operations and effects is the same as in the embodiment shown in FIG. 12.

Figure 14:
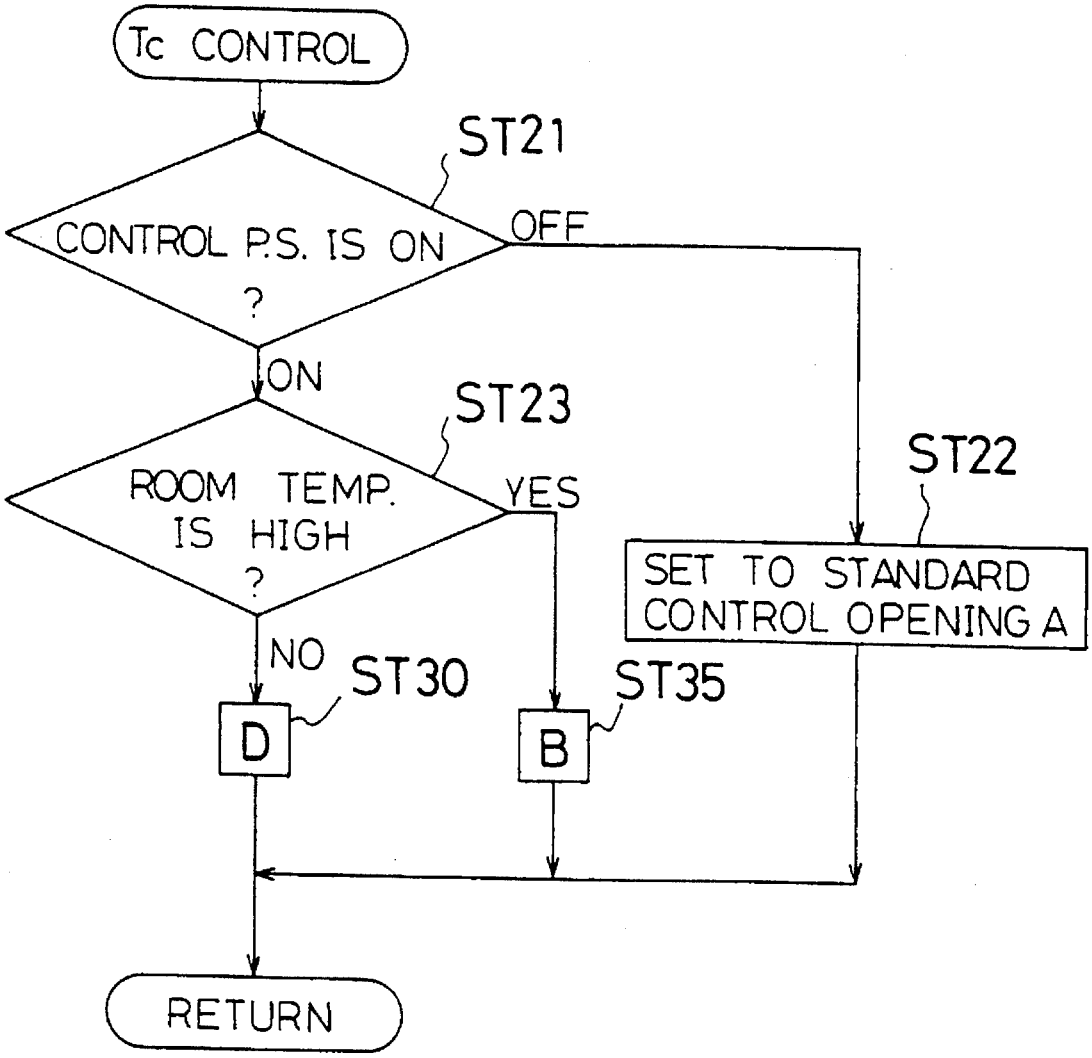
FIG. 14 is a flow chart showing another modified example of control of the motor-operated expansion valve.

FIG. 14 shows an embodiment according to claim 18 of an air conditioner of the present invention. In this embodiment, the steps ST24–ST29 are omitted from the embodiment shown in FIG. 12 and judgment is made with relation to only a temperature Tr of room air and no judgment is made with relation to a discharge-pipe temperature Td and a temperature Te of an indoor heat exchange.

Accordingly, the sequence is moved from the step ST23 to the step ST30 or the step ST35. In detail, at the step ST23, there is judged whether the temperature Tr of room air to be detected by the room temperature sensor (Thr) is over a set temperature. When the temperature Tr is the set temperature and less, the sequence is moved to the step ST30 and then returned. When the temperature Tr is over the set temperature, the sequence is moved to the step ST35 and then returned. At the step ST30, since it is considered that the rising of the pressure HP of the high-pressure refrigerant results from increase of a supercooling degree owing to lowness of the temperature Tr of room air, the opening of the motor-operated expansion valve (25) is set to the first compensation opening D which is wider than the reference control opening A and has the greatest opening amount.

At the step ST35, since the temperature Tr of room air is slightly low, the opening of the motor-operated expansion valve (25) is set to the third compensation opening B which is wider than the reference control opening A and has the smallest opening amount.

Other components, operations and effects are the same as in the embodiment shown in FIG. 12.

In the above-mentioned embodiments, the expansion-valve control means (72) is composed so as to control an expansion vale based on a discharge-pipe temperature. In this invention, however, the expansion-valve control means (72) may be composed so as to control the expansion valve based on a super-heating degree by using respective temperatures of inflow-side refrigerant and outflow-side refrigerant at the indoor heat exchanger (31).

Further, in the embodiments, the bypass control means (74, 74*a*) is composed so as to control the shut-off valve (SV) based on a high-pressure control signal from the high-pressure-control pressure switch (HPS2). However, the bypass control means (74, 74*a*) may be composed so as to control the shut-off valve (SV) based on a temperature Tc of an outdoor heat exchange to be detected by the outdoor heat-exchange sensor (Thc) or a temperature Te of an indoor heat exchange to be detected by the indoor heat-exchange sensor (The). In other words, a pressure HP of high-pressure refrigerant may be calculated based on the temperature Tc of the outdoor heat exchange or the temperature Te of the indoor heat exchange. Further, the bypass control means (74, 74*a*) may be composed so as to control the shut-off valve (SV) based on either of only the pressure HP of high-pressure refrigerant and only the discharge-pipe temperature Td, in other words, so as to execute only control based on a high pressure or only control based on a wet running.

In the embodiments shown in FIGS. 7 and 8, a liquid temperature sensor may be provided at an end part of liquefied refrigerant in the outdoor heat exchanger (23) (on an outflow side of refrigerant in the cooling operation cycle) and a supercooling degree may be directly detected by the liquid temperature sensor and the outdoor heat-exchange sensor (Thc). Further, in the embodiments shown in FIGS. 12 and 13, a liquid temperature sensor may be provided at an end part of liquefied refrigerant in the indoor heat exchanger (31) (on an outflow side of refrigerant in the heating operation cycle) and a supercooling degree may be directly detected by the liquid temperature sensor and the indoor heat-exchange sensor (The).

INDUSTRIAL APPLICABILITY

As described above, an air conditioner of the present invention is suitable as an air conditioner for large building in which the construction of the air conditioner should be simplified, since the air conditioner regulates a circulation amount of refrigerant by a refrigerant regulator and stores surplus refrigerant in the refrigerant regulator.

We claim:

1. An air conditioner comprising a closed refrigerant circulating circuit (1) having a compressor (21), a thermal-source-side heat exchanger (23), an expansion mechanism (25) into which refrigerant flows in both directions and a used-side heat exchanger (31) which are connected in this order, and being reversibly operatable between a cooling operation cycle and a heating operation cycle, wherein said refrigerant circulating circuit (1) is provided with a refrigerant regulator (4), between said expansion mechanism (25) and said used-side heat exchanger (31), for storing liquefied refrigerant and supplying to said used-side heat exchanger (31) refrigerant of a corresponding amount to a storage amount of the liquefied refrigerant in the cooling operation cycle and for storing liquefied refrigerant in the heating operation cycle, wherein said refrigerant regulator (4) has a storage casing (41), a first flow pipe (42) which is connected at one end thereof to said thermal-source-side heat exchanger (23) via said expansion mechanism (25) and connected at the other end to said storage casing (41), and a second flow pipe (43) which is connected at one end thereof to said used-side heat exchanger (31) and led at the other end into said storage casing (41), and there is formed in said second flow pipe (43) aperture means for passing liquefied refrigerant therethrough between the inside of said second flow pipe (43) and the inside of said storage casing (41) so as to increase an area passable for the liquefied refrigerant as the storage amount of the liquefied refrigerant increases.

2. The air conditioner according to claim 1, wherein said aperture means is composed of plural refrigerant holes (45, 45 . . . ) arranged on said second flow pipe (43) in a vertical direction thereof.

3. The air conditioner according to claim 1, wherein said aperture means is a slit formed on said second flow pipe (43) in a vertical direction thereof.

4. The air conditioner according to claim 1, wherein said expansion mechanism (25) is a motor-operated expansion valve (25) whose opening is adjustable and said air conditioner further comprising: high-pressure detection means (HPS2) for detecting a pressure of high-pressure refrigerant in said refrigerant circulating circuit (1); and expansion-valve control means (72) for adjusting said motor-operated expansion valve (25) to a reference control opening based on a state of the refrigerant in said refrigerant circulating circuit (1).

5. The air conditioner according to claim 4, further comprising widening control means (73) for outputting widening signal to said expansion-valve control means (72) when the pressure of high-pressure refrigerant detected by said high-pressure detection means (HPS2) in said refrigerant circulating circuit (1) in the cooling operation cycle reaches to a set value, whereby said expansion-valve control means (72) controls the opening of said motor-operated expansion valve (25) to be a compensation opening wider than the reference control opening.

6. The air conditioner according to claim 4, further comprising:

supercooling judgment means (75) for judging a supercooling degree of the refrigerant in said thermal-source-side heat exchanger (23) in the cooling operation cycle; and opening compensation means (76) for outputting an opening signal to said expansion-valve control means (72) when the pressure of high-pressure refrigerant detected by said high-pressure detection means (HPS2) in said refrigerant circulating circuit (1) in the cooling operation cycle reaches to a set value, whereby said expansion-valve control means (72) controls the opening of said motor-operated expansion valve (25) to be a compensation opening wider than the reference control opening and widens the compensation opening according to increase of the supercooling degree Judged by said supercooling judgment means (75).

7. The air conditioner according to claim 6, wherein said supercooling judgment means (75) judges the supercooling degree based on a temperature of the outside air.

8. The air conditioner according to claim 6, wherein said supercooling judgment means (75) judges the supercooling degree based on a temperature of the outside air and a condensation temperature of the refrigerant in said thermal-source-side heat exchanger (23).

9. The air conditioner according to claim 6, wherein said supercooling judgment means (75) judges the supercooling degree based on a temperature of the outside air, a temperature of the refrigerant on a discharge side in said compressor (21) and a condensation temperature of the refrigerant in said thermal-source-side heat exchanger (23).

10. The air conditioner according to claims 1, 3, 5, 6, or 7, further comprising a by-pass line (12) which is connected at one end thereof to said refrigerant regulator (4) and at the other end between said refrigerant regulator (4) and said used-side heat exchanger (31) and which has a shut-off valve (SV).

11. The air conditioner according to claim 10, further comprising bypass control means (74) for shutting off said shut-off valve (SV) in the heating operation cycle, for opening said shut-off valve (SV) in the cooling operation cycle and for shutting off said shut-off valve (SV) till a pressure of high-pressure refrigerant in said refrigerant circulating circuit (1) lowers to a set value when the pressure of high-pressure refrigerant rises to a set high pressure in the cooling operation cycle.

12. The air conditioner according to claim 10, further comprising bypass control means (74) for shutting off said shut-off valve (SV) in the heating operation cycle, for opening said shut-off valve (SV) in the cooling operation cycle and for shutting off said shut-off valve (SV) for a set period when a temperature of the refrigerant on the discharge side in said compressor (21) reaches to a set low temperature in the cooling operation cycle.

13. The air conditioner according to claim 4, further comprising widening control means (73*a*) for outputting a widening signal to said expansion-valve control means (72) when a pressure of high-pressure refrigerant detected by said high-pressure detection means (HPS2) in said refrigerant circulating circuit (1) in the heating operation cycle reaches to a set value, whereby said expansion-valve control means (72) controls the opening of said motor-operated expansion valve (25) to be a compensation opening wider than the reference control opening.

14. The air conditioner according to claim 4, further comprising:

supercooling judgment means (75*a*) for judging a supercooling degree of the refrigerant in said used-side heat exchanger (31) in the heating operation cycle; and opening compensation means (76*a*) for outputting a widening signal to said expansion-valve control means (72) when the pressure of high-pressure refrigerant detected by said high-pressure detection means (HPS2) in said refrigerant circulating circuit (1) in the heating operation cycle reaches to a set value, whereby said expansion-valve control means (72) controls the opening of said motor-operated expansion valve (25) to be a compensation opening wider than the reference control opening and widens the compensation opening according to increase of the supercooling degree judged by the supercooling judgment means (75*a*).

15. The air conditioner according to claim 14, wherein said supercooling judgment means (75*a*) judges the supercooling degree based on a room temperature.

16. The air conditioner according to claim 14, wherein said supercooling judgment means (75*a*) judges the supercooling degree based on a room temperature and a condensation temperature of the refrigerant in said used-side heat exchanger (31).

17. The air conditioner according to claim 14, wherein said supercooling judgment means (75*a*) judges the supercooling degree based on a room temperature, a temperature of the refrigerant on a discharge side in said compressor (21) and a condensation temperature of the refrigerant in said used-side heat exchanger (31).

* * * * *